US011536047B1

(12) United States Patent
Widén

(10) Patent No.: US 11,536,047 B1
(45) Date of Patent: Dec. 27, 2022

(54) KEY PLUG, A CYLINDER LOCK, A CYLINDER LOCK AND KEY COMBINATION AND A METHOD TO MANUFACTURE A KEY PLUG

(71) Applicant: WINLOC AG, Schweiz (CH)

(72) Inventor: Bo Widén, Torshälla (SE)

(73) Assignee: WINLOC AG, Zug Schweiz (CH)

( * ) Notice: Subject to any disclaimer, the term of this patent is extended or adjusted under 35 U.S.C. 154(b) by 0 days.

(21) Appl. No.: 17/892,992

(22) Filed: Aug. 22, 2022

(51) Int. Cl.

| | |
|---|---|
| ***E05B 27/00*** | (2006.01) |
| ***E05B 19/00*** | (2006.01) |
| ***E05B 27/10*** | (2006.01) |
| ***E05B 27/08*** | (2006.01) |

(52) U.S. Cl.
CPC ..... *E05B 27/0007* (2013.01); *E05B 19/007* (2013.01); *E05B 19/0052* (2013.01); *E05B 19/0058* (2013.01); *E05B 27/083* (2013.01); *E05B 27/10* (2021.08)

(58) Field of Classification Search
CPC ..... E05B 19/0041; E05B 19/0052; E05B 19/0058; E05B 27/0007; E05B 27/02; E05B 27/08; E05B 27/083; E05B 27/10; E05B 19/0029; E05B 19/007
See application file for complete search history.

(56) References Cited

U.S. PATENT DOCUMENTS 1,438,336 A * 12/1922 Schroeder ..... E05B 19/0017 70/393
2,318,887 A * 5/1943 Ramsell ..... E05B 27/00 70/358
2,803,959 A 8/1957 Schlage
2,814,941 A 12/1957 Best
4,099,398 A 7/1978 Lipschutz
4,114,411 A 9/1978 Schlage
4,282,731 A 8/1981 Taksony
4,294,093 A 10/1981 Best et al.
4,320,638 A * 3/1982 Dunphy ..... E05B 19/0017 70/358
4,386,510 A 6/1983 Best et al.
(Continued)

FOREIGN PATENT DOCUMENTS

AT 004293 U1 5/2001
CA 2179675 A1 12/1996
(Continued)

*Primary Examiner* — Christopher J Boswell
(74) *Attorney, Agent, or Firm* — Birch, Stewart, Kolasch & Birch, LLP

(57) ABSTRACT

A key plug rotatable within a cylindrical bore of a cylinder lock. An upper relatively narrow part of a keyway has a small lateral width no more than 33% of the maximum width of a lower relatively wide part of the keyway and extends obliquely upwards along a first direction pointing away from a second lower side wall of a lower part and being inclined at a relatively small angle α, in the interval 3° to 12°, relative to the vertical mid-plane. The sideways or lateral location of the upper relatively narrow part of the keyway is such that an imaginary downward extension thereof, substantially in a second direction opposite to the first direction down to an outer cylindrical contour of the key plug, will fall onto the outer cylindrical contour at a same second side of the vertical mid-plane and inside the second lower side wall of the keyway.

20 Claims, 10 Drawing Sheets

(56) References Cited

U.S. PATENT DOCUMENTS

| | | | | |
|---|---|---|---|---|
| 4,416,128 | A * | 11/1983 | Steinbrink | E05B 19/0029 70/409 |
| 4,787,225 | A | 11/1988 | Haüser et al. | |
| 4,823,575 | A | 4/1989 | Florian et al. | |
| 5,050,412 | A | 9/1991 | Errani | |
| 5,136,869 | A | 8/1992 | Best | |
| 5,176,015 | A | 1/1993 | Sussina | |
| 5,185,917 | A | 2/1993 | Kremen | |
| 5,272,895 | A | 12/1993 | Best | |
| 5,493,884 | A | 2/1996 | Hinz et al. | |
| 5,507,163 | A | 4/1996 | Juang | |
| 5,617,750 | A | 4/1997 | Preddey | |
| RE35,518 | E * | 5/1997 | Sussina | E05B 27/0053 70/369 |
| 6,014,877 | A | 1/2000 | Shen | |
| 6,503,032 | B1 | 1/2003 | Simonsson | |
| 7,647,798 | B1 | 1/2010 | Jones et al. | |
| 8,205,473 | B2 * | 6/2012 | Widen | E05B 19/0029 70/405 |
| 8,210,009 | B2 * | 7/2012 | Widen | E05B 19/0017 70/405 |
| 8,312,749 | B2 | 11/2012 | Tong | |
| 8,539,803 | B2 * | 9/2013 | Widen | E05B 19/0029 70/495 |
| 8,800,333 | B2 | 8/2014 | Rao et al. | |
| 9,598,880 | B2 | 3/2017 | Walls et al. | |
| 10,273,717 | B2 * | 4/2019 | Clifford | E05B 27/005 |
| 2004/0016273 | A1 | 1/2004 | Keller | |
| 2007/0017264 | A1 | 1/2007 | Seliber | |
| 2008/0016928 | A1 | 1/2008 | Yang et al. | |
| 2008/0163657 | A1 | 7/2008 | Dickhans et al. | |
| 2008/0276675 | A1 | 11/2008 | Herdman | |
| 2009/0217720 | A1 | 9/2009 | Herdman | |
| 2010/0005842 | A1 | 1/2010 | Herdman | |
| 2011/0289989 | A1 | 12/2011 | Reine et al. | |
| 2011/0289990 | A1 | 12/2011 | Piotrowski et al. | |
| 2015/0240525 | A1 | 8/2015 | Walls et al. | |

FOREIGN PATENT DOCUMENTS

| | | | |
|---|---|---|---|
| CH | 717636 | B1 | 1/2022 |
| CN | 103737248 | A | 4/2014 |
| CZ | 2015-456 | A3 | 8/2016 |
| CZ | 31363 | U1 | 1/2018 |
| DE | 2516340 | A1 | 11/1975 |
| DE | 7729544 | U1 | 1/1978 |
| DE | 3021331 | C2 | 3/1981 |
| DE | 3245856 | A1 | 6/1984 |
| DE | 4127915 | A1 | 3/1993 |
| DE | 4237341 | A1 | 5/1994 |
| DE | 4314724 | A1 | 11/1994 |
| DE | 4316439 | A1 | 11/1994 |
| DE | 29502687 | U1 | 4/1995 |
| DE | 29506683 | U1 | 6/1995 |
| DE | 29510153 | U1 | 10/1995 |
| DE | 29703063 | U1 | 6/1997 |
| DE | 19712009 | A1 | 10/1997 |
| DE | 29720129 | U1 | 4/1998 |
| DE | 19706822 | A1 | 8/1998 |
| DE | 19741118 | A1 | 3/1999 |
| DE | 19821850 | C1 | 9/1999 |
| DE | 10050386 | A1 | 4/2002 |
| DE | 10333211 | A1 | 3/2005 |
| DE | 102004026064 | B3 | 6/2005 |
| EP | 0161654 | A2 | 11/1985 |
| EP | 0386504 | A1 | 9/1990 |
| EP | 0574752 | A1 | 12/1993 |
| EP | 0637663 | A1 | 2/1995 |
| EP | 0780530 | A1 | 6/1997 |
| EP | 0846819 | A1 | 6/1998 |
| EP | 0928867 | A2 | 7/1999 |
| EP | 1600585 | A2 | 11/2005 |
| EP | 2333203 | A2 | 6/2011 |
| EP | 2390030 | A2 | 11/2011 |
| EP | 3219882 | B1 | 7/2018 |
| EP | 3366870 | A1 | 8/2018 |
| EP | 3366871 | A1 | 8/2018 |
| EP | 3418476 | A1 | 12/2018 |
| EP | 3542950 | A1 | 9/2019 |
| FR | 1443313 | A | 6/1966 |
| FR | 2388966 | A1 | 11/1978 |
| GB | 190122782 | A | 1/1902 |
| GB | 2356016 | A | 5/2001 |
| SE | 467265 | B | 6/1992 |
| WO | WO 93/10323 | A1 | 5/1993 |
| WO | WO 00/15374 | A1 | 3/2000 |
| WO | WO 01/36768 | A1 | 5/2001 |
| WO | WO 03/004806 | A1 | 1/2003 |
| WO | WO 2013/121114 | A1 | 8/2013 |
| WO | WO 2016/098133 | A1 | 6/2016 |
| WO | WO 2020/053461 | A1 | 3/2020 |

* cited by examiner

KEY PLUG, A CYLINDER LOCK, A CYLINDER LOCK AND KEY COMBINATION AND A METHOD TO MANUFACTURE A KEY PLUG

CROSS-REFERENCE TO RELATED APPLICATIONS

The disclosures of U.S. application Ser. No. 17/892,931 entitled A KEY BLANK, A CODED KEY AND A CYLINDER LOCK AND KEY SYSTEM WITH IMPROVED STOP ARRANGEMENT filed on Aug. 22, 2022 and U.S. application Ser. No. 17/892,938 entitled A KEY BLANK, A KEY AND A CYLINDER LOCK AND KEY COMBINATION, filed on Aug. 22, 2022 the entire contents of which are hereby incorporated by reference.

FIELD OF THE INVENTION

The present invention concerns a key plug for a cylinder lock, including a cylindrical body with a cylindrical contour around a rotary axis, configured to enable a rotary motion of the key plug in a cylindrical bore in a housing of an associated cylinder lock. A longitudinal keyway extends in the cylindrical body along a vertical mid-plane MP passing through or adjacent to the rotary axis and being configured to accommodate a substantially flat key blade of an associated key for releasing the cylinder lock. A row of radially oriented central bores are located in a vertical central plane VP passing through the rotary axis and communicating with the longitudinal keyway. A row of central locking pins are movable in the central bores and are configured for locking the key plug against rotation relative to the housing unless the key blade of the associated key has been inserted into a longitudinal position in the keyway which enables a release of the cylinder lock by turning the key and the key plug in the cylindrical bore of the housing. A cross-sectional profile of the keyway, along a major longitudinal portion of the key plug, is confined within a rectangle having a height being at least 2.5 times greater than a width thereof. The cross-sectional profile includes a lower relatively wide part, having a maximum width being substantially the same as or slightly less than the width of the rectangle, the maximum width being 75% to 100% of the width of the rectangle, measured between a first lower side wall and a second lower side wall, and an upper relatively narrow part serving to enable an interaction between an inserted key blade and the movable central locking pins in the central bores, and possibly an interconnecting part, adjoining to the lower and upper parts of the keyway so as to extend therebetween along the vertical mid-plane.

The "vertical mid-plane" is intended to define a plane which is located between the lateral side walls of the keyway. Here, "vertical" refers to the orientation shown in the drawing figures, and "mid" is intended to define a location substantially centrally between the lateral sides of the rectangle without necessarily being located exactly in the middle between these lateral sides.

However, all parts of the keyway should be confined substantially within the rectangle and extend along or substantially in parallel with the "vertical mid-plane", all the way from the bottom to the top.

It should also be pointed out that in this disclosure, the terms "upper," "lower," "vertical" and "horizontal" are used with reference to the illustrated embodiments and may just as well be reversed or changed to a different orientation of the key blade when being used in practical applications.

The scope of the invention also includes a cylinder lock, a cylinder lock and key combination, and a method to manufacture a key plug.

BACKGROUND OF THE INVENTION AND PRIOR ART

Such key plugs, cylinder locks and cylinder lock and key combinations have been developed gradually from a basic design created long ago, namely by Linus Yale Junior in the 1860s, and are still being improved by various measures in order to increase the security against unauthorized opening of the lock and facilitating a rational production of locks and keys in large numbers. A wide-spread overall structure of the key plug, and a substantially flat key blade of a corresponding key or key blank, includes generally a cross-sectional profile consisting of three parts, each having a specific task, viz. a lower relatively wide part, serving mainly to guide the key blade in the keyway of the cylinder lock, an interconnecting part, serving to make it more difficult to manipulate the cylinder lock, when there is no properly cut key inserted into the keyway, and an upper, relatively narrow part having an edge portion serving to position a row of central locking pins in the central bores into predetermined locations so as to release the lock.

A contemporary example of such a lock and key system is disclosed in the published European patent application EP 3,366,870 A1 (ASSA AB), where the improvement relates to a stop arrangement defining a selectable stop for the full insertion of the key blade into the keyway of the plug, where the key can be turned together with the key plug and release the cylinder lock. The keyway in the key plug of the associated lock has a corresponding number of longitudinal recesses and ribs, and inclined portions, so that the key blade of the associated key will fit slidingly with some play within the keyway. In the cross-sectional profile of the key blade and the corresponding keyway, in the part extending vertically between the lower and upper parts and thus forming an interconnecting part, there are several portions being inclined in alternating directions. The inclinational angles, relative to a central plane, are quite large, so that the adjacent portions will form relatively sharp bends therebetween. This is a type of key blade and keyway configuration which is frequently used today in cylinder lock and key systems.

Owing to the bends between the inclined portions of the profiled keyway, the security of the cylinder lock is enhanced, since it is relatively difficult to reach, from below, the upper part of the keyway, where the lower ends of the locking pins are accommodated when the key has been withdrawn. Thus, it is difficult to observe or find out how to move the locking pins so as to open the lock, and the zig-zag or bent configuration of the interconnecting part of the keyway will therefore deter lock-picking attempts from below, in particular via the lower relatively wide part of the keyway. Of course, the lower relatively wide keyway is a part of the lock which is relatively easy to reach, because of its relatively large width.

OBJECT OF THE INVENTION

An object of the present invention is to provide a key plug having a keyway with a relatively simple geometrical shape, which has no alternating directions of adjacent inclined portions and no sharp bends therebetween and which is still advantageous in respect of manufacture and use, rendering a good strength of the associated key blank structure, and a reliable and effective use when forming part of a lock and key combination or system.

A further object is to provide a structure of the key plug, which will further facilitate rapid and rational manufacturing of cylinder lock and key combinations in large numbers, in particular with a rational method that simplifies the manufacturing of key plugs of cylinder locks.

A still further object is to provide, in spite of a relatively simple geometrical shape, a structure of the key plug which will maintain a sufficiently high security against manipulation and unauthorized opening of cylinder locks having such key plugs.

SUMMARY OF THE INVENTION

According to the present invention, the above objects are met by providing a basic structure of the key plug as recited above in the section "FIELD OF THE INVENTION," wherein the upper relatively narrow part of the keyway has a relatively small lateral width being no more than 33% of the maximum width of the lower relatively wide part of the keyway and extends obliquely upwards along a first direction pointing away from the lower side wall of the lower part and being inclined at a relatively small angle $\alpha$, in the interval 3° to 12°, relative to the vertical mid-plane. The sideways or lateral location, within the rectangle, of the upper relatively narrow part of the keyway, including first and second upper side walls thereof, is such that an imaginary downward extension thereof, substantially in a second direction opposite to the first direction down to an outer cylindrical contour of the key plug, will fall onto the outer cylindrical contour at a same second side of the vertical mid-plane and inside the second lower side wall of the keyway.

With such a configuration of the key plug, including a relatively narrow, slightly inclined upper part of the keyway, the above objects are achieved.

Thus, the inclinational angle $\alpha$ of the upper part of the keyway, relative to the vertical mid-plane, is only 3° to 12°, which is a rather small angle. Nevertheless, this small angle is significant and effective, and will provide an increased security against lock-picking, in spite of the very simple structure of the keyway, as will be explained below. The inclinational angle $\alpha$ may be 5° to 10°, in particular 8° to 9°.

The "vertical mid-plane" is possibly displaced sideways, in relation to the vertical lower part of the keyway.

In an embodiment, the lower relatively wide part of the keyway includes, at a vertical level adjacent to an interconnecting part, a laterally offset region located substantially at a same lateral side of the vertical mid-plane as the second lower side wall of the keyway, wherein the interconnecting part of the keyway adjoins to the laterally offset region of the lower part and extends vertically upwards therefrom, with a central side wall located in the vicinity of the vertical mid-plane and being inclined in the first direction, away from the laterally offset region of the lower part, and with an outside side wall located above and adjoining, possibly via a transition, to the second lower side wall of the keyway, and the upper part of the keyway forms an upward extension of the interconnecting part, forms, at the first upper side wall, an upward extension of the central side wall of the interconnecting part, and also adjoins, at the opposite second upper side wall, to the outside wall of the interconnecting part, possibly via a transition.

This configuration of the keyway will increase the security against picking and manipulation, since there is only a limited access from below to the central bores accommodating the lower central locking pins.

More particularly, the interconnecting part of the keyway is configured so as to establish a free visual communication between the lower relatively wide part of the longitudinal keyway and the central bores only via a respective narrow opening passage, denoted NOP, being offset laterally sideways in relationship to the vertical mid-plane, predominantly on the second side of the vertical mid-plane, whereas the first upper side wall of the upper part is located predominantly on the opposite first side of the vertical mid-plane, and the narrow opening passage NOP, as seen in a direction in parallel to the vertical mid-plane MP, has a lateral width which is less than 25% of the maximum width of the lower relatively wide part.

The narrow opening passage NOP will make it rather difficult to reach the central bores and the lower central locking pins when there is no key present in the keyway.

The relatively small lateral width of the upper part of the keyway may be substantially uniform along the vertical extension of the upper part, possibly with a tapering uppermost portion thereof. As will be apparent below, this will facilitate the manufacturing of the keyway by using a rotating cutter disc unit.

Advantageously, at least a part of the first and second upper side walls of the upper part of the keyway are located on a first side and on a second side, respectively, of the vertical mid-plane, and a central side wall of the interconnecting part of the keyway may cross the vertical mid-plane. So, the upper part of the keyway will be located centrally in relation to the vertical mid-plane.

With regard to the central bores and the lower locking pins, a lower end portion of a respective central bore may be tapered, possibly conically or as a chisel, and may accommodate an associated central locking pin with a correspondingly tapered lower end portion, which has a lowermost central end surface at its apex. This lowermost central end surface, preferably having a rounded shape, will be at least partly concealed when being observed or manipulated from underneath, when there is no associated key inserted into the keyway and the associated central locking pin is being held in its lowermost position.

In order to improve the security, the total height of the interconnecting part and the upper part may be in the interval 50% to 85% of a total height of the keyway. In this way, there will be a relatively long distance from the lower part of the keyway up to the lower locking pins being accommodated in the central bores in the key plug.

In an embodiment, the lower part of the keyway has an upper first transverse wall located substantially on the same lateral side of the vertical mid-plane as the first upper side wall of the upper part of the keyway, the transverse wall forming a corner with an adjoining central side wall of the interconnecting part, the corner being located in the vicinity of the vertical mid-plane, and the first transverse wall forming at least a part of a first step-like transition between the lower part and the interconnecting part.

Furthermore, the first transverse wall may extend laterally all the way from the first lower side wall of the lower part to the corner, so as to form the first step-like transition. Alternatively, the first step-like transition may comprise an upward extension, configured to accommodate a ridge of an associated key blade, the upward extension having an outside wall portion adjoining to the first lower side wall of the lower part of the keyway, a top wall portion, and an inside wall portion adjoining to the first transverse wall. The first transverse wall will thus form only a part of the first step-like transition, and there is formed a centrally located downwardly directed tongue being defined by the inside wall portion, the first transverse wall with the corner, and the central side wall of the interconnecting part.

Moreover, the second upper side wall of the upper part of the keyway may adjoin, as a substantially straight extension through the interconnecting part to the second lower side wall of the lower part, or there may be a second transition on the other side of the vertical mid-plane, where the second upper side wall of the upper part adjoins to the outside surface of the interconnecting part.

The key plug may comprise a front end portion extending along less than half of a total length of the key plug, and an adjoining rear end portion along more than half of the total length. The front end portion accommodates a side locking mechanism with side locking tumblers reaching into the longitudinal keyway, whereas the rear end portion may accommodate one or more additional lock components at a lateral side of the longitudinal keyway, a structure which is previously known per se from the U.S. Pat. No. 10,337,210 B2 (Widén) relating to an interchangeable cylinder lock core for a cylinder lock unit, and the corresponding continuation-in-part U.S. Pat. No. 10,570,643 B2 (Widén) relating to a cylinder lock core for a cylinder lock unit.

According to these patent specifications, there is at least one side code pattern confined entirely to a front region of the rotatable key plug of the lock, and the side locking tumblers of each side locking mechanism are movable independently of each other with at least three different code positions for each coded side locking tumbler and a plurality of different code combinations for each side locking mechanism.

However, in the present invention, the side code locking mechanism of the cylinder lock may extend either along only a part of the entire length of the key plug or, alternatively, it may extend along substantially the entire length thereof, from the front end widened portion to the rear end. Thus, a person having ordinary skill in the art may very well combine the teachings of the above two U.S. patents, without necessarily having a coded side locking mechanism being confined only to a front region of the key plug, and the present disclosure when designing a lock and key system, within the scope of the appended claims of the present invention. Thus, for example, the key plug may comprise, on one or both lateral sides of the keyway, in a rear end portion of the key plug, a longitudinal prong hole for accommodating a longitudinal prong configured to transfer a torque from the key plug to a locking member in an associated lock unit. Alternatively, there may be located some other lock component in the key plug on a lateral side of the keyway.

As indicated above, within the scope of the present invention, the key plug may be combined with an associated housing so as to form a cylinder lock.

In a cylinder lock according to the invention, there being possibly one or more side locking tumblers on one or both lateral sides of the keyway, each side locking tumbler may be movable in an associated cavity and may have a transverse projecting finger reaching into the keyway of the key plug, the side locking tumbler cooperating with the housing, possibly via a side bar, when a correctly cut key has been inserted into a longitudinal position in the keyway which enables a release of the cylinder lock by turning the key and the key plug in the cylindrical bore of the housing.

Moreover, within the scope of the appended claims, the cylinder lock may be combined with an associated key having a substantially flat key blade, so as to form a cylinder lock and key combination, the substantially flat key blade having at least one key code pattern, namely a central key code pattern adjacent to an upper edge surface of an upper part of the substantially flat key blade, with a longitudinal row of coded cuts, configured to interact with the movable central locking pins in the key plug of the cylinder lock, and possibly also at least one side code pattern in a respective side surface portion of the key blade, configured to interact with side locking tumblers of a side code mechanism of the cylinder lock.

The present invention also concerns a method to manufacture a key plug from a key plug blank having a cylindrical body with a cylindrical outer contour around a rotary axis, a longitudinal keyway extending in the cylindrical body along a vertical mid-plane MP passing through or adjacent to the rotary axis, a row of radially oriented central bores located in the cylindrical body in a vertical central plane VP passing through the rotary axis and communicating with the longitudinal keyway, a cross-sectional profile of the keyway consisting of at least two parts, viz. a lower relatively wide part and an upper relatively narrow part, and possibly an interconnecting part, adjoining to the lower and upper parts so as to extend therebetween along the vertical mid-plane. The method comprises machining the longitudinal keyway into the key plug blank, before or after drilling the radially oriented central bores with axes located in the vertical central plane VP, and wherein, in one major step, at least the upper part of the keyway in the key plug blank is machined by means of a first cutter disc unit including a rotating first cutter disc, which is held in a plane which is slightly inclined at a selected angle $\alpha$, in the interval 3° to 12°, relative to the vertical mid-plane of the key plug, the vertical mid-plane MP of the keyway being possibly displaced sideways in relation to the vertical central plane VP of the central bores, a distance no more than 15% of a maximum lateral width of the lower relatively wide part, and the rotating first cutter disc is moved longitudinally along the blank with a cutting depth including the lower part, the possible interconnecting part and the upper part of the keyway.

In this way, the keyway of the key plug may be manufactured in a rapid and simple manner, possibly without having to use broaching tools, as is normally done when producing key plugs for mechanical cylinder locks. The costs will be reduced, and the method according to invention will be rational, rapid and cost-effective. Still, the security of cylinder locks with such key plugs will be sufficiently high, as will be described in detail below.

The rotating first cutter disc unit may include a driving shaft, on which the first cutter disc is mounted, the driving shaft being maintained, during the longitudinal movement of the rotating cutter disc, at the selected, relatively small angle $\alpha$ relative to an axis which is perpendicular to the vertical mid-plane MP.

Possibly, further machining steps may be carried out, before or after the one major step, in order to further widen or to modify the keyway as desired in the lower part, the possible interconnecting part and/or the upper part of the keyway.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF PREFERRED EMBODIMENTS OF THE KEY PLUG, THE CYLINDER LOCK, THE CYLINDER LOCK AND KEY COMBINATION AND A METHOD TO MANUFACTURE THE KEY PLUG OF THE INVENTION

Basic Structure of the Cylinder Lock and Key Combination

In FIGS. 1*a* to 9, there is shown schematically a cylinder lock and key combination, including a cylinder lock 990 and a key 100, the latter being formed from a key blank (see FIGS. 12 to 23).

Figure 1A:
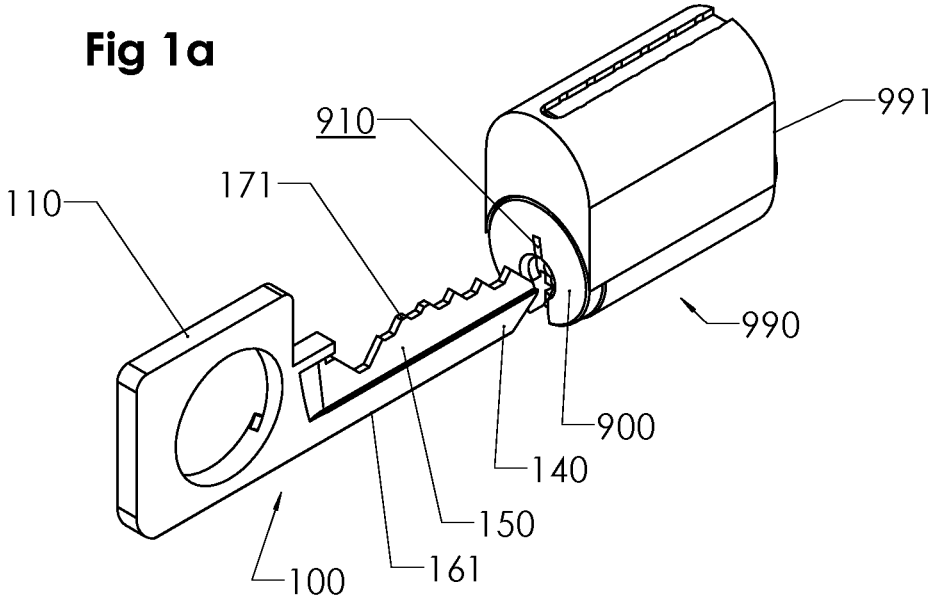
FIG. 1*a* shows, in a perspective view, a key and an associated cylinder lock with a housing and a rotatable key plug according to the present invention.
Figure 2:
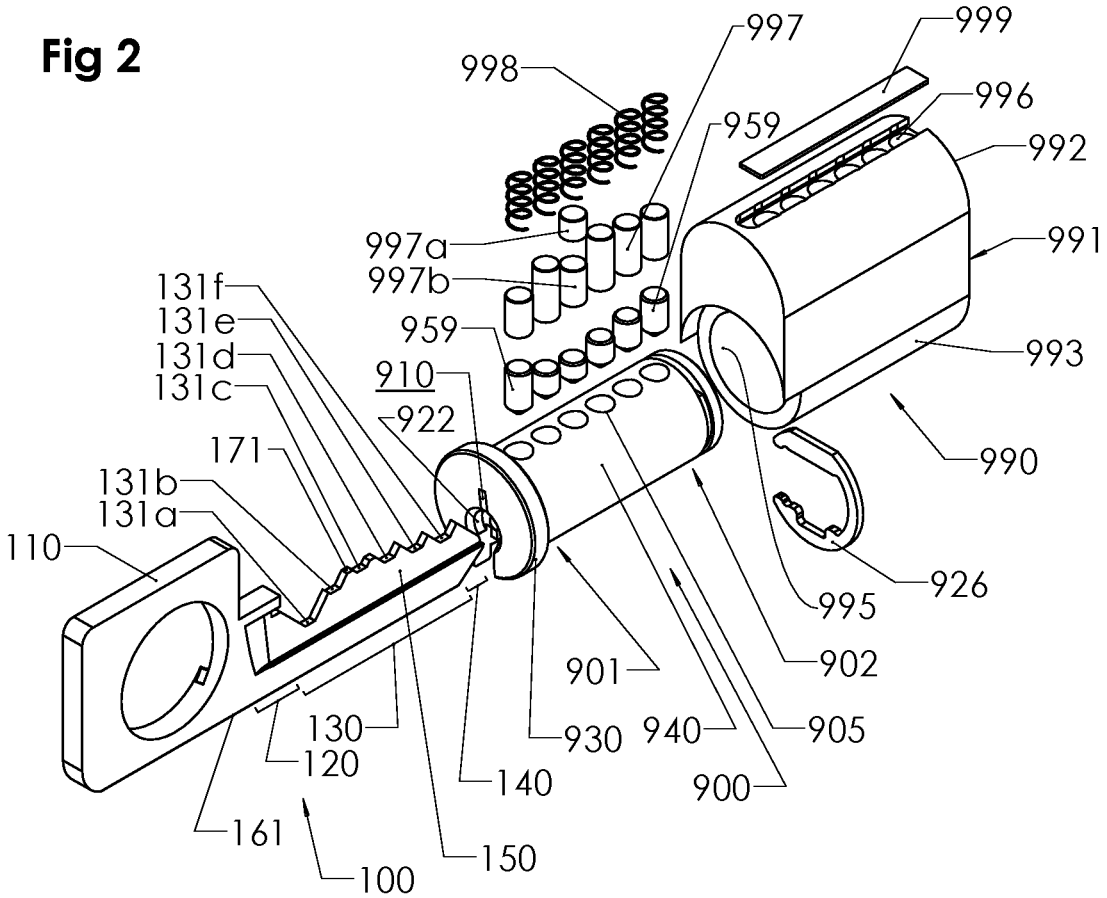
FIG. 2 shows, in an exploded perspective view, the key, the key plug and the housing of FIG. 1*a*, including a row of central locking pins and other internal components of the cylinder lock and key combination.

As shown in FIGS. 1*a* and 2, the key 100 includes a grip portion 110 and a key blade 150 extending from the grip portion 110 via a connecting portion 120 and a bitting portion 130 (provided with coded cuts) to a free tip portion 140. The key blade 150 has a lower edge surface 161 and an upper edge surface 171, the latter forming a central key code pattern in the form of V-cuts 131*a*, 131*b*, 131*c*, 131*d*, 131*e* and 131*f*.

Figure 1B:
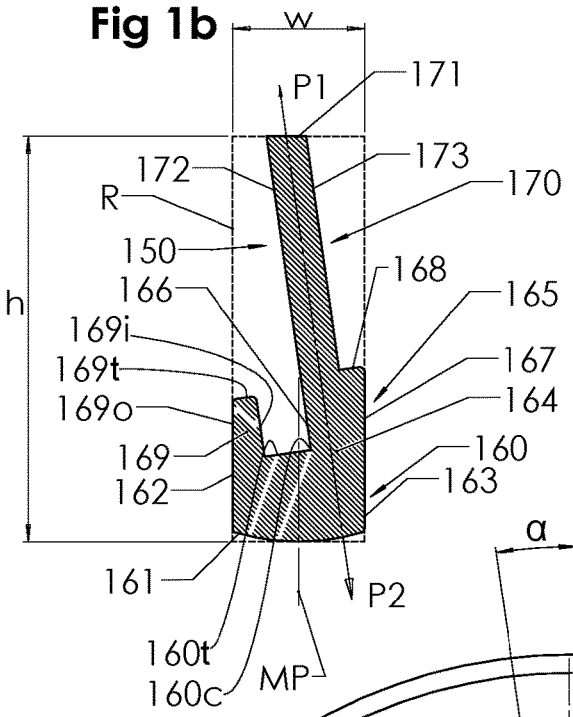
FIG. 1*b* shows, in a larger scale, a cross-sectional profile of the key blade of the key of FIG. 1*a;*
Figure 4A:
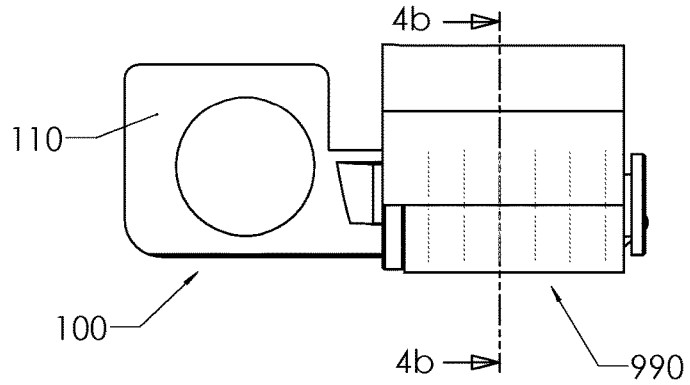
FIG. 4*a* shows, in a side view, the key and the cylinder lock of FIGS. 1*a*, 2 and 3.
Figure 4B:
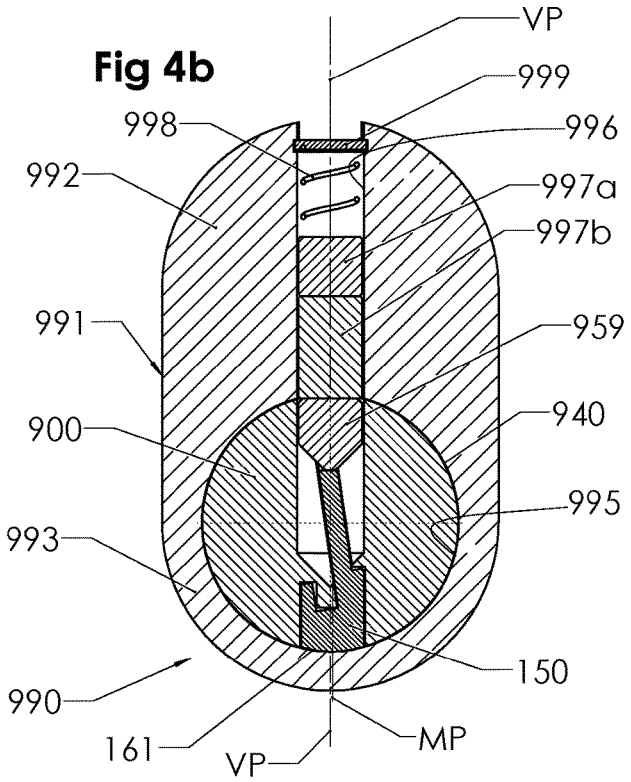
FIG. 4*b* is a cross-sectional view, in a larger scale, of the key and the cylinder lock, taken along the line 4*b*-4*b* in FIG. 4*a;*

With reference to FIG. 1*b* and FIG. 4*b* (and also FIGS. 12 to 23), the key blade 150 may be made in one piece and has a cross-sectional profile consisting of three parts, from the lower edge surface 161 to the upper edge surface 171, viz. a lower part 160, an interconnecting part 165 and an upper part 170. It should be noted that it is possible to leave out the interconnecting part 165 and have a key blade with just a lower relatively wide part and an upper relatively narrow part.

The associated lock 990 (see FIG. 2) comprises a housing 991 and a rotatable cylindrical key plug 900. The housing 991 has an elongated cross-section (compare also FIGS. 3, 4*b* and 6*a*) with an upper part 992 and a lower part 993. The lower part 993 has a longitudinally extending cylindrical bore 995, in which the cylindrical key plug 900 is rotatably journaled.

Figure 6A:
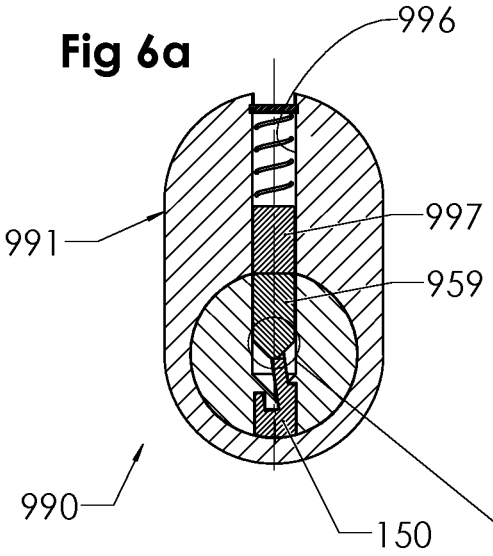
FIG. 6*a* shows a cross-sectional view, along the line 6*a*-6*a* of FIG. 5*a*, of the cylinder lock and the inserted key blade.

In the upper part 992 of the housing 991 (see FIGS. 2, 4*b* and 6*a*), there is a row of central bores 996, in the example six of them normally situated with their axes located in a vertical central plane VP normally coinciding with the vertical mid-plane MP of the key blade 150 when the latter is inserted into the key plug 900 (and the key plug 900 is in its releasing or non-locking position, as shown in FIGS. 4*b* and 6*a*). Each central bore 996 accommodates an upper locking pin 997, one of them being divided into a first part 997*a* and a second part 997*b*, each of these upper locking pins 997, 997*a*, 997*b* being biased downwardly by a helical spring 998. The upper ends of the helical springs 998 are held in place by a cover plate 999.

Figure 5A:
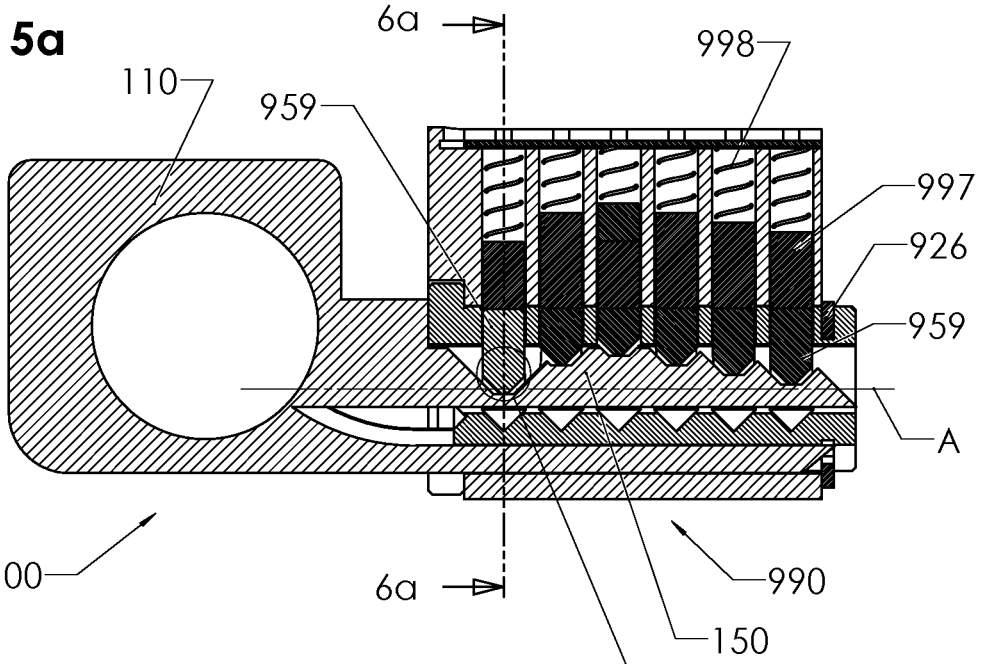
FIG. 5*a* shows, in a longitudinal sectional view and also in a larger scale, the key being inserted into the cylinder lock of FIG. 4*a*, illustrating also the upper and lower central locking pins cooperating and engaging with V-cuts in the upper part of the key blade.

In the example shown, with the correctly cut key blade 150 of the key 100 inserted into the lock 900, the upper locking pins 997, 997*a*, 997*b* are positioned with their lower ends located at a shear line at the cylindrical surface of the bore 996, so that the key plug 900 may rotate therein, as will be understood from FIGS. 4*b*, 5*a* and 6*a*.

The rotatable key plug 900 (see FIG. 2) has an outer cylindrical surface 940 fitting with a small play inside the cylindrical bore 995 of the housing 991 and, at a front end portion 901, a radially widened end portion 930, which has a larger radius than the cylindrical surface 940 and serves to hold the key plug 900 in place longitudinally in the lower part 993 of the housing 991, together with a stop member formed by a resilient stop ring 926 at a rear end portion 902 of the key plug 900.

The key plug 900 has a row of central bores 905, also six of them, with the same diameter and spacing as the bores 996 of the housing 991. Accordingly, the upper locking pins 997, 997*a* may be pushed down into the central bores 905 of the key plug, if and when the key blade 150 of the key 100 is withdrawn from the key plug 900 of the lock 990 (compare FIG. 9).

Figure 5B:
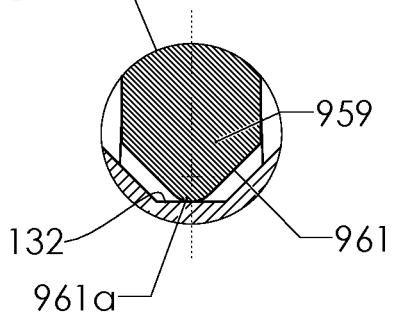
FIG. 5*b* shows, in a larger scale, a detail from FIG. 5*a*, illustrating the contact between one of the lower locking pins and a V-cut of the key blade.
Figure 6B:
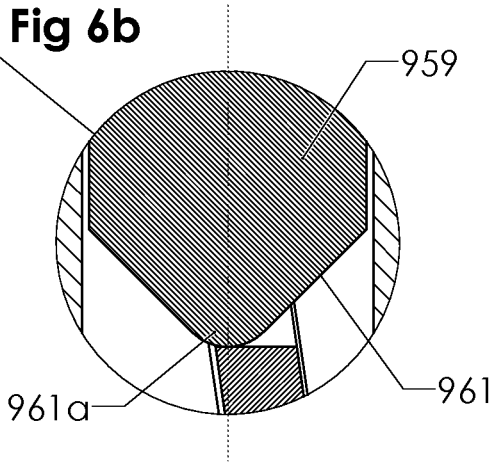
FIG. 6*b*, shows, in a larger scale, a detail from FIG. 6*a*, illustrating the contact between the lower locking pin and the V-cut shown also in FIG. 5*b;*

The central bores 905 of the key plug 900 accommodate a corresponding number (six of them) of lower locking pins 959. As appears from FIGS. 5*b* and 6*b*, the lower ends of the lower locking pins 959 each have a tapered end portion 961 with a smoothly rounded apex 961*a*. The end portions 961 may be conical (as shown) or part-cylindrical and will contact, with their apexes 961*a*, each one of the above-mentioned V-cuts 131*a* to 131*f* forming the upper edge surface 171 of key blade 150, each with a short planar bottom 132 which is horizontal (as seen in FIG. 5*b*) and parallel to the longitudinal direction A (FIG. 5*a*) of the key blade 150.

As appears from FIGS. 4*b* and 6*a*, the lower edge surface 161 of the lower relatively wide portion 160 of the key blade 150 is part-cylindrical with the same curvature as the cylindrical surface 940 of the key plug 900.

The lock and key combination of the present invention includes a configuration of the key blade 150 with an inclined upper part 170 and an adjoining inclined lateral side surface of the interconnecting part 165, and a corresponding geometrical shape of the keyway. Thus, according to the present invention, the cross-sectional profiles of the key blade 150 (FIGS. 1*b* and 1*c*) and the corresponding keyway 910 are novel and include a combination of elements with a relatively narrow upper part 170/970 being slightly inclined in relation to a vertical mid-plane MP. The inclinational angle α is rather small, in the interval 3° to 12°, possibly 5° to 10°, in particular about 8°, as shown in FIGS. 24 to 28.

It is to be noted, however, that the very simple configuration of the key blade 150 of the key 100 (FIG. 1*b*) or key blank from which it is formed, and the corresponding keyway 910 (FIG. 1*c*) in the key plug 900 of the associated cylinder lock 990 makes quite a difference thanks to the inclined upper part 170/970 of the key blade/keyway, which extends obliquely upwards along a first direction P1 (FIG. 1*b*), with the above-mentioned inclinational angle α. Moreover, the sideways or lateral location of the upper part of the key blade is such that an imaginary downward extension thereof, including the first upper side surface 172 (to the left in FIG. 1*b*) and the second upper side surface 173 (to the right in FIG. 1*b*), substantially in a second direction P2 opposite to the first direction P1, will fall onto the lower edge surface 161 at a same second side of the mid-plane MP (to the right in FIG. 1*b*) and inside a second lower side surface 163 of the lower part 160 of the key blade 150.

Figure 1C:
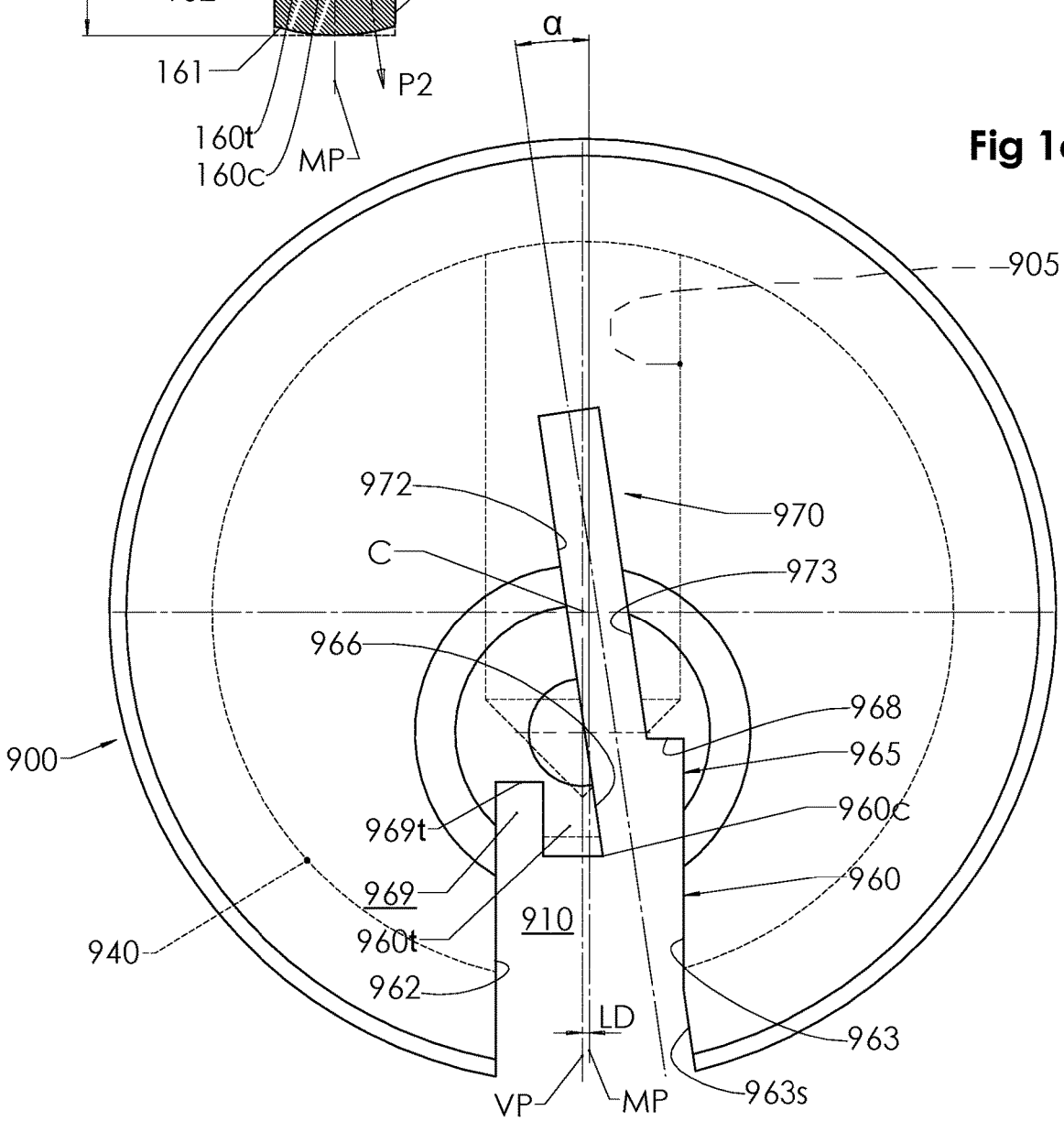
FIG. 1*c* shows, in an even larger scale, an end view of the key plug of FIG. 1*a;*
Figure 3:
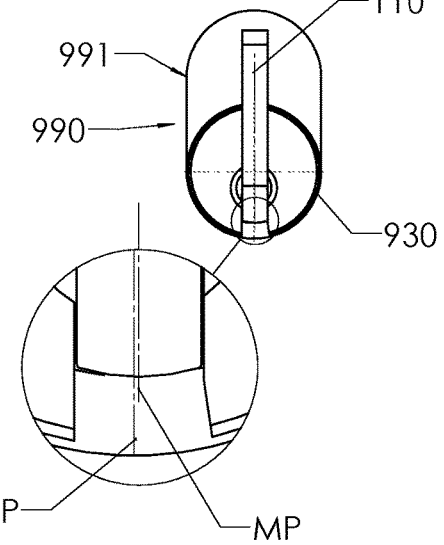
FIG. 3 shows, in an end view, the key and the lock of FIGS. 1*a* and 2, the key being inserted into the key plug of the cylinder lock.

Similarly, see FIG. 1*c*, the cross-sectional profile of the corresponding keyway 910, in which the key blade is fitted slidingly, has an upper part 970 being inclined in the same way as the upper part 170 of the key blade 150, and an imaginary downward extension of the upper part 970, which will fall onto an outer cylindrical contour at a same second side of the vertical mid-plane and inside the second lower side wall of the keyway.

As to the geometrical configuration of the substantially flat key blade 150, the cross-sectional profile is confined within a rectangle having a height h (FIG. 1*b*) which is at least 2.5 times larger than a width w thereof.

In the particular embodiment shown in FIG. 1*b*, the lower relatively wide part 160 of the key blade includes a laterally offset region 164 located at a same lateral side of the mid-plane MP as the second lower side surface 163 of the lower part 160. An interconnecting part 165 adjoins to this laterally offset region 164 and extends vertically upwards therefrom. The interconnecting part 165 has a central side surface 166 located in the vicinity of the vertical mid-plane MP and is inclined in the first direction P1, away from the offset region 164. An outside side surface 167 of the interconnecting part 165 adjoins to the second lower side surface 163 of the lower part 160. The upper part 170 forms an upward extension of the interconnecting part 165, with a straight extension of the central side surface 166. Also, the upper part 170 forms, at the opposite second upper side surface 173, a straight surface which adjoins to the outside surface 167 of the interconnecting part 165, via a step-like transition 168.

The upper part 170 is uniformly wide, in this embodiment, along the entire vertical extension thereof. In a possible alternative embodiment, it may be tapered upwardly in an uppermost portion.

As appears from FIG. 1*b*, the first and second upper side surfaces 172, 173 of the upper part 170 of the key blade 150 are located on a first side (to the left) and on a second side (to the right), respectively, of the vertical mid-plane MP.

A total height of the interconnecting part 165 and the upper part 170 of the key blade 150, in this embodiment, is almost 80% of the total height h of the key blade 150. According to the invention, this ratio may be in the interval 50% to 85%. Of course, corresponding geometrical relations will apply to the keyway 910 shown in FIG. 1*c*.

Furthermore, in the shown embodiment, the central side surface 166 of the interconnecting part 165 crosses the vertical mid-plane MP very close to the upper end of the interconnecting part 165.

The lower part 160 of the key blade 165 has an upper first transverse surface 160*t* located substantially on the same side of the mid-plane MP as the first lower side surface 162. This surface 160*t* will form a corner 160*c* with the adjoining central side surface 166 of the interconnecting part 165. The corner 160*c* is located in the vicinity of the vertical mid-plane MP. In the shown embodiment, the transverse portion 160*t* forms a part of a step-like transition between the lower part 160 and the interconnecting part 165. Alternatively, the transverse surface 160*t* may extend laterally all the way from the first lower side surface 162 to the corner 160*c*, so that the transverse surface forms a rather long step-like transition. Such an embodiment is shown in FIGS. 12 to 17.

Figure 18:
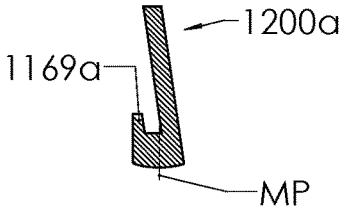
FIGS. 18, 19 and 20 illustrate three variants of a second embodiment of a key blank.
Figure 19:
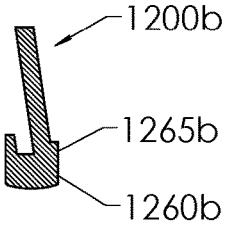
Figure 20:
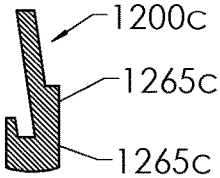
Figure 21:
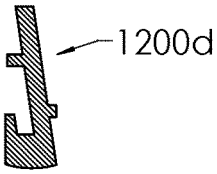
FIGS. 21, 22 and 23 illustrate three further variants of the second embodiment.
Figure 22:
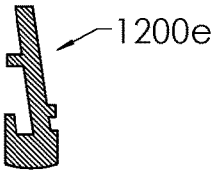
Figure 23:
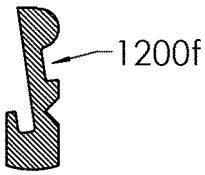
Figure 24:
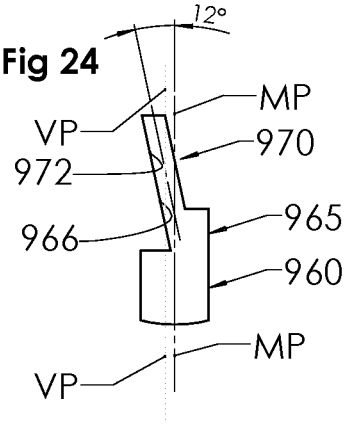
FIGS. 24, 25, 26, 27 and 28 show various profiles of keyways configured to slidingly receive keys of the kind shown in FIG. 13, indicating different inclinational angles of the upper and interconnecting parts of the key blade and the corresponding keyway.
Figure 25:
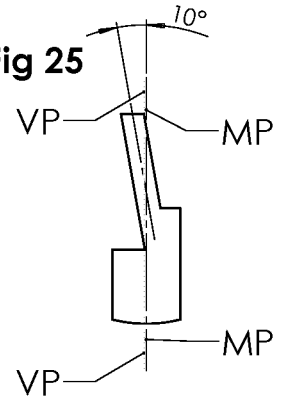
Figure 26:
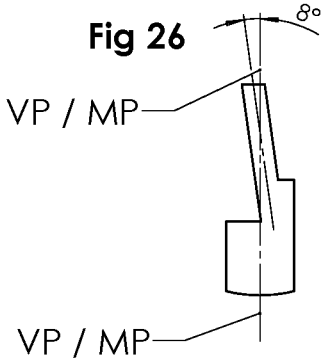
Figure 27:
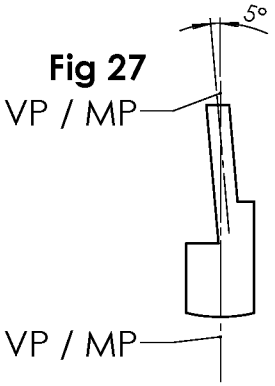
Figure 28:
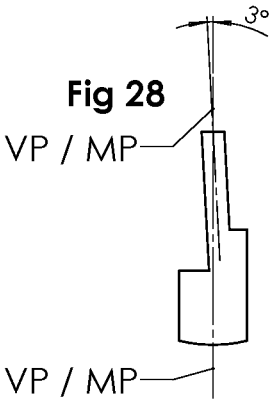

In the embodiment of FIG. 1*b*, and those shown in FIGS. 18 to 20, the step-like transition (to the left) includes an upward ridge 169, which extends in parallel to the interconnecting part 165. The ridge 169 has an outside surface portion 1690 adjoining to the first lower side surface 162, a top surface portion 169*t* and an inside surface portion 169*i* adjoining to the first transverse surface 160*t*. Thus, the first transverse surface 160*t* forms only a part of the first step-like transition, and there is formed an undercut groove being defined by the inside surface portion 169*i* of the ridge 169, the first transverse surface 160*t* with the corner 160*c*, and the central side surface 166 of the interconnecting part 165.

On the right-hand side of FIG. 1*b*, the second upper side surface 173 adjoins to the outside surface 167 of the interconnecting part 165 via the step-like transition 168.

The two basic embodiments of the key blade having a slightly inclined upper part 170 are shown in FIGS. 12 to 23, where a first embodiment (FIGS. 12 to 17) has a long step-like transition with a transverse surface 1160*t* extending all the way from the first lower side surface to the corner 1160*c*, and a second embodiment (FIGS. 18 to 23) has an upward ridge portion 1169*a* extending a limited distance in parallel to the upper part 1200*a* (FIG. 18) or to the interconnecting part 1265*b*, 1265*c* (FIGS. 19 and 20), the latter adjoining smoothly to the lower part 1260*b*, 1260*c* on the right hand side.

Returning to the FIG. 1*c*, it should be noted that the mid-plane MP of the keyway 910 of the key plug may be somewhat displaced in relation to the central vertical plane VP passing through the rotary axis C (FIG. 1*c*) of the cylindrical part 940 (indicated by a dashed circle) of the key plug 900. Thus, the mid-plane MP of the keyway 910 may be displaced laterally sideways with a lateral distance LD being no more than 15% of the width w of the rectangle R within which the corresponding key blade 150 (and thus also the keyway 910) is confined.

The above-described basic configuration of the key blade (and the corresponding key blank without coded cuts) and the corresponding keyway of the key plug, will facilitate a rapid and rational manufacturing of key blanks or coded keys and also the associated locks in large numbers in a cost-effective way, without the need for different portions in the interconnecting part to be oriented in alternating directions and sharp bends therebetween. Also, the security of the associated locks, against manipulation and picking the lock, will be maintained at a sufficiently high level, as will be discussed further below.

Security Against Manipulation of the Lock of the Cylinder Lock and Key Combination As appears from FIGS. 7*a*, 7*b* and 8*a*, 8*b*, owing to the basic structure of cylinder lock and key combination described above, the interconnecting part 965 and the upper part 970 of the keyway 910 are constricted laterally, so as to establish a free visual communication only through a narrow opening passage between the lower relatively wide part 960 of the keyway 910 and each central bore 905 in the upper part of the key plug 900, each central bore 905 accommodating a respective lower central pin 959. This narrow opening passage, denoted NOP, as seen from below along the vertical plane VP (FIG. 7*b*, see also FIGS. 8*a* and 8*b*), is defined by a corner portion 960*c* of a downwardly directed tongue 960*t* of the key plug material and by a transverse, substantially horizontal lower surface 960*ts* thereof forming a step-like transition of the keyway 910. It will be apparent from FIGS. 7*b* and 8*b* that only a segment or side portion 961*s* of the tapered end portion 961 (FIGS. 5*b* and 6*b*) of each lower locking pin 959 is visible and accessible from below, when the key 100 has been withdrawn from the keyway 910.

Figure 8A:
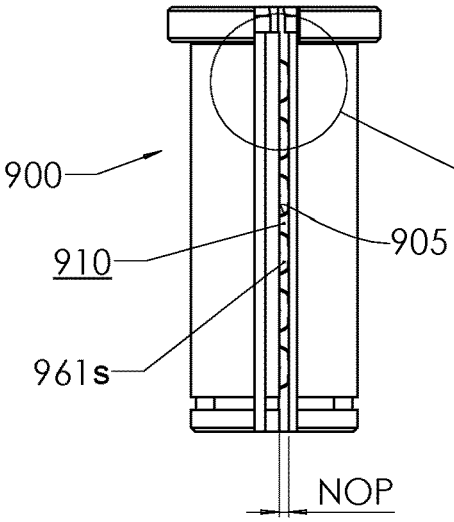
FIG. 8*a* is a view of the key plug from below, illustrating how the central bores are only partially accessible from underneath via a narrow opening passage, denoted NOP.
Figure 8B:
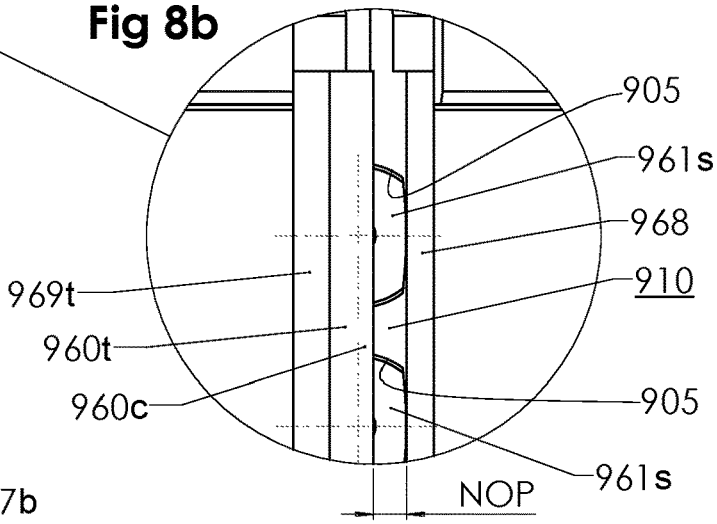
FIG. 8*b* is an enlarged detail from FIG. 8*a;*
Figure 9:
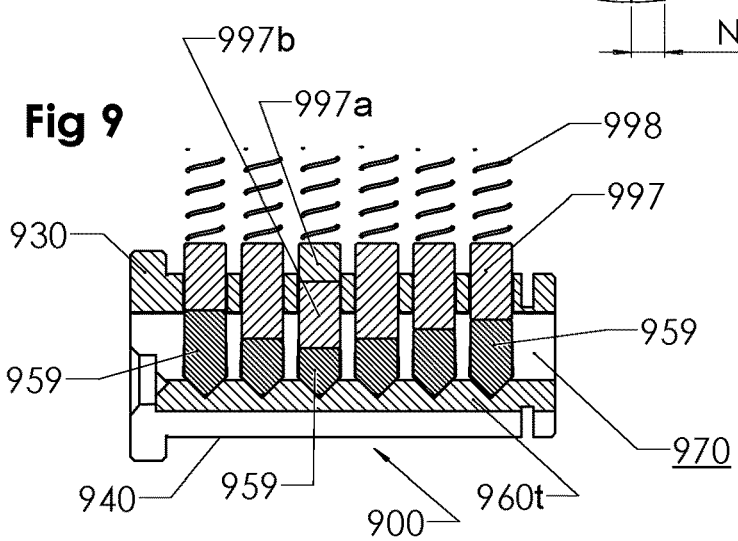
FIG. 9 is a longitudinal section of the key plug, taken along the line 9-9 in FIG. 7*a;*

More particularly, as will be seen from FIG. 8*b*, the segment or side portion 961*s* of each locking pin end portion 961, which is visible and accessible from below, does not include the apex 961*a* (FIGS. 5*b*, 6*b*, 7*b*) of the tapered end portion 961, since the apex is concealed by the corner portion 960*c* of the downwardly directed tongue 960*t*, due to the inclined direction of the interconnecting and upper parts 965, 970 of the keyway and the laterally offset location of the narrow opening passage NOP in relation to the vertical axes of the bores 905 defining the vertical central plane VP. Accordingly, it will be difficult, by optical or mechanical inspection to determine how far each lower locking pin 959 has to be moved upwards in order to be positioned with its upper end surface at the releasing shear line, i.e. the positions shown in FIGS. 4*b*, 5*a* and 6*a*. Of course, as shown in FIG. 9, all the lower locking pins 959 are held in their lowermost positions by means of the upper locking pins 997 and the helical springs 998, and there is therefore no easy way to distinguish one from the other in respect of their coded lengths or heights.

Figure 7A:
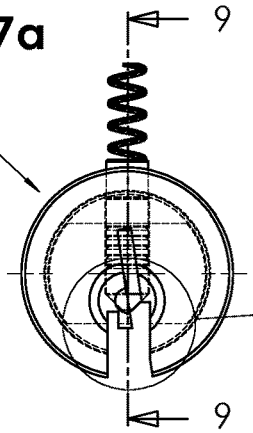
FIG. 7*a* is a detailed front view of the key plug, illustrating how the keyway communicates with an upper central bore accommodating a lower central locking pin, there being no key inserted into the keyway.
Figure 7B:
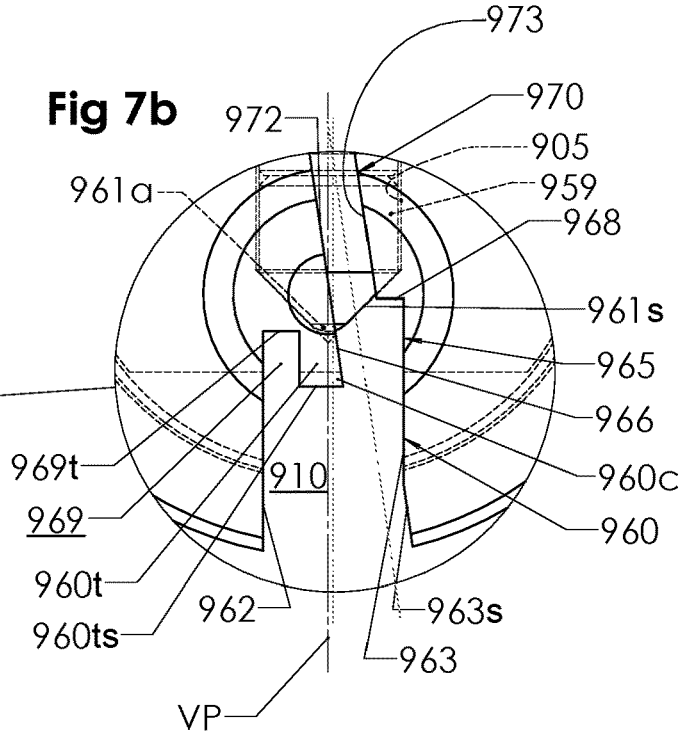
FIG. 7*b* is an enlarged detail from FIG. 7*a;*

As appears best from FIGS. 1*c* and 7*b*, the lower relatively wide part 960 of the keyway 910 extends upwards on both sides of the vertical central plane VP, with lateral side wall portions 962, 963 being substantially parallel to each other, except for a lowermost, slanted surface portion 963*s* (being formed in the part 930 of the key plug when forming an initial keyway slot by means of a rotating cutter disc), up to the downwardly directed tongue 960*t*. From there, the keyway 910 continues upwards on the second side (to the right) of the corner portion 960*c* of the tongue 960*t*. On the first side, to the left of the tongue 960*t*, it extends up to a transverse, substantially horizontal surface 969*t*, which forms together with the tongue 960*t* a lateral pocket 969 or constriction of the width of the keyway 910, leaving only a narrow opening passage NOP (FIGS. 8*a* and 8*b*) on the second, right hand side of the keyway. The pocket or 969 recess underneath the transverse wall surface 969*t* will accommodate the ridge portion 169 of the key blade when the latter is inserted into the keyway. On the right-hand side of the keyway, the interconnecting part 965 extends upwardly up to the above mentioned horizontal wall surface, which forms a step-like transition 968 to the even narrower, upper part 970 of the keyway 910.

In the embodiment shown in FIGS. 7*a*, 7*b*, 8*a*, 8*b* and 9, the pocket 969 forming a lateral constriction of the keyway 910 located in parallel to the upwardly extending interconnecting part 965 may thus prevent any picking tool to be moved upwards from the lower relatively wide part 960 on the first or left hand side of the vertical plane VP where it will be caught by the pocket 969 up to the transverse, substantially horizontal surface 969*t* or by the downwardly directed tongue 960*t*, the only opening passage being the one to the right of the downwardly directed tongue 960*t*, along the inclined surface portions 966 and 972 in the interconnecting and uppermost parts 965, 970 of the keyway 910.

When following this narrow opening passage NOP (FIGS. 8*a* and 8*b*), any picking tool will meet the segment or side portion 961*s* of the tapered end portion 961 of the central locking pin 959 which is curved in two dimensions (if the end portion is conical) away from the entry direction and is therefore difficult to engage or grip.

Figure 11:
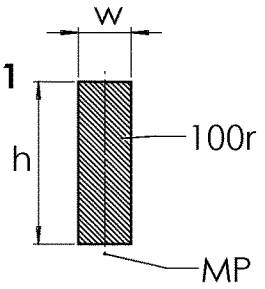
FIG. 11 is a cross-sectional view taken along the line 11-11 in FIG. 10, showing the rectangular blade.
Figure 10:
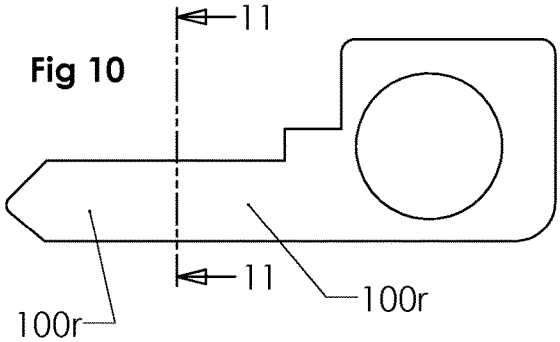
FIG. 10 shows schematically a side view of a rectangular blade with a grip portion from which a key blank may be machined.

Some Preferred Embodiments of the Key Blade of a Key Blank or Key in a Cylinder Lock and Key Combination The key blade 150 of the key blank or key according to the invention may be formed by machining a rectangular blade 100*r* as shown in FIG. 11, the cross-sectional view being taken along the line 11-11 in FIG. 10, i.e. at the bitting portion between the connecting portion and the free tip portion of the key blade to be formed.

The rectangular blade 100*r* has typically the dimensions 8 to 9 mm (height "h", measured along a vertical central plane MP) and 2.5 to 3 mm (maximum width "w", measured perpendicularly to the vertical central plane VP). The key may be of the kind disclosed in the above-mentioned continuation-in-part U.S. Pat. No. 10,570,643 B2 (Widen). Alternatively, the key may be of the kind disclosed in U.S. Pat. No. 10,337,210 B2 (Widen) relating to a small format interchangeable cylinder lock core ("SFIC") for a cylinder lock unit. In the latter case, the dimensions would be 8 mm (height, "h") and 2.7 mm (maximum width, "w").

In FIGS. 12-23, two different embodiments are shown, each in a number of variants, a first embodiment according to FIGS. 12 to 17, and a second embodiment according to FIGS. 18 to 23.

Figure 12:
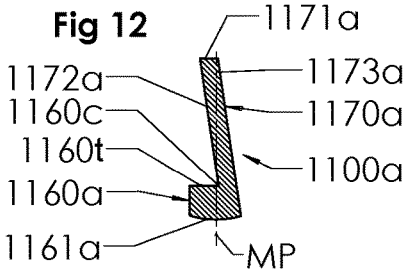
FIGS. 12, 13 and 14 illustrate three variants of a first embodiment of a key blank formed from the rectangular blank of FIGS. 10 and 11.

In FIG. 12, the key blank 1100*a* has a lower part 1160*a*, where the lower edge surface 1161*a* is slightly curved, with a curvature corresponding to the curvature of the associated cylindrical key plug in which it is intended to be inserted during use thereof. The height of the lower part 1160*a* is 15% to 50% of the total height h, measured from the lower edge surface 1161*a* to the upper edge surface 1171*a*, whereas the height of the rest of the key blank, above the lowermost part is 50% to 85% of the total height h.

On the first side of the lower part 1160*a*, to the left in the drawing, there is a step-like transition with a transverse, substantially horizontal surface 1160*t* extending all the way to a corner 1160*c*, where the lower part 1160*a* adjoins upwardly to a slightly inclined upper part 1170*a* having a first inclined lateral side surface 1172*a* and an opposite, second lateral side surface 1173*a*. The lateral side surfaces 1172*a*, 1173*a* are both inclined, with an inclinational angle α of 3 to 12 degrees, in particular about 8 degrees, relative to the vertical central plane MP, as discussed above. In this particular variant of the first embodiment, the second lateral side surface 1173*a* reaches all the way from the upper edge surface 1171*a* down to the lower edge surface 1161*a*, so there is no step-like transition on this second side of the key blank.

Figure 13:
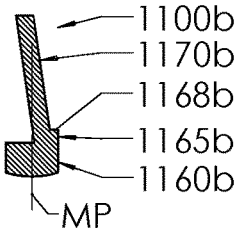

In a second variant of the first embodiment, shown in FIG. 13, the structure of the key blank 1100*b* is the same as in FIG. 12, except that on the second side, to the right in the drawing, there is a step-like transition 1168*b* where the second lateral side surface of the upper part adjoins to a transverse, substantially horizontal surface. Here, an interconnecting part 1165*b* is located vertically between the upper part 1170*b* and the lower part 1160*b*.

Figure 14:
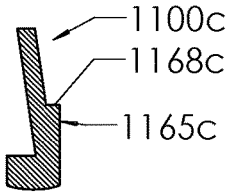

In a third variant of the key blade 1100*c*, shown in FIG. 14, the structure is like the structure of FIG. 13, except that the step-like transition 1168*c* at the second side (to the right) is located at a higher vertical level. So, the interconnecting part 1165*c* has a longer vertical extension in this variant.

Figure 15:
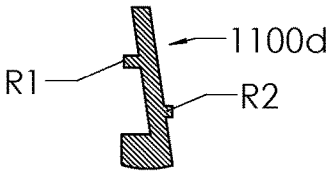
FIGS. 15, 16 and 17 illustrate further variants of the first embodiment.
Figure 16:
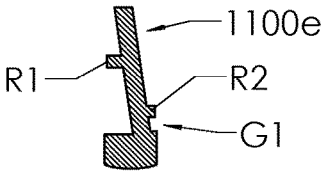
Figure 17:
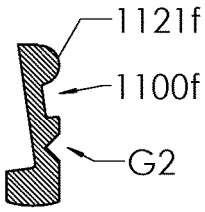

The variants 1100*d*, 1100*e*, 1100*f* of the first embodiment shown in FIGS. 15, 16 and 17 correspond, in respect of the division of the key blank into two or three parts, to the structures of FIGS. 12, 13 and 14, respectively, the only difference being that there are relatively small ribs R1, R2 extending longitudinally on the upper and interconnecting parts (FIGS. 15 and 16) and relatively shallow grooves G1, G2 extending longitudinally along the interconnecting part and partially along the lower part (FIGS. 16 and 17). Such ribs and grooves may be formed by methods being well-known in the art, for example, with rotating cutter tools. Also, in the variant 1100*f* (FIG. 17), there is longitudinal rib portion 1121*f* extending along the connecting portion (denoted 120 in FIG. 2) of the key blade, as will be explained further below.

The second embodiment of the key blank, shown in FIGS. 18 to 23, with the variants 1200*a*, 1200*b*, 1200*c*, 1200*d*, 1200*e* and 1200*f*, corresponds essentially to the above described first embodiment, except that on the first (left hand) side of the lower part, there is a ridge 1169*a* (FIG. 18) extending upwards in parallel to the interconnecting and/or the upper part on the other side of the vertical central plane MP. Such a ridge has been described above, and the variant of the key blank 1200*c* in FIG. 20, corresponds essentially to the embodiment of the key blade 150 described above with reference to the FIGS. 1*b*, 4*b* and 6*a*.

Some Embodiments of the Key Plug According to the Invention

One embodiment of a key plug 900 according to the invention has been described in detail above, with reference to the FIGS. 1*c*, 7*a*, 7*b*, 8*a*, 8*b* and 9. Those skilled in the art will understand that various embodiments and variants of the key plug, within the scope of the present invention, will correspond to and have essentially the same profile cross-sections as the keys and key blanks as described above with reference to the FIGS. 12 to 23. The difference in respect of the dimensions will be tolerances being necessary to enable a sliding movement of each key in an associated key plug. Also, the inclinational angle of the upper part (and possibly at least a portion of the interconnecting part) may vary between 3° and 12°, as exemplified in FIGS. 24 to 28. Moreover, to secure a sufficient security against lock picking or manipulation of a cylinder lock provided with the key plug, the width of the upper part of the keyway (970 in FIG. 1*c*) should be at most 33% of the maximum width of the lower part thereof, corresponding substantially to the width w of the key blade of FIG. 1*b*, possibly with a minor added width increment at the lowermost part of the keyway shown in FIG. 1*c*, between the side walls 962 and 963*s*. Such a width increment may be added in case the inclinational angle α is relatively large, for example in the interval 8° to 12°. However, the width increment will not be larger than 10% of the width between the parallel side surfaces 962 and 963 of the lower part 960 of the keyway 910.

In FIGS. 25 to 28 it is also illustrated that, for inclinational angles α having a value from 3° to 10°, it is possible to let the vertical mid-plane MP of the keyway (and thus the key blade of the associated key or key blank) coincide with vertical central plane VP of the circular cylindrical portion 940 (FIG. 2) of the key plug. For larger values, in particular 12°, it is possible to displace the keyway somewhat (to the left in the drawings) so as to ensure that the downward (imaginary) extension of the outer side wall of the upper part 970 will fall within the lower part 960 of the keyway.

Some Additional Embodiments Within the Scope of the Present Invention

As indicated above and as shown in FIG. 2, the present invention as claimed also includes a cylinder lock, provided with a key plug as described above and an associated housing in which the key plug is rotatably journaled, as well as a cylinder lock and key combination or system.

Generally, a key code pattern may be formed on the key blade in an upper edge code portion of the upper part thereof, i.e. a centrally located key code pattern (such as the V-cuts 131*a* to 131*f* provided on the embodiments described above), and possibly also in a lateral side surface portion of the lower part and the interconnecting part of the key blade, on one or both lateral sides of the key blade.

Figure 29:
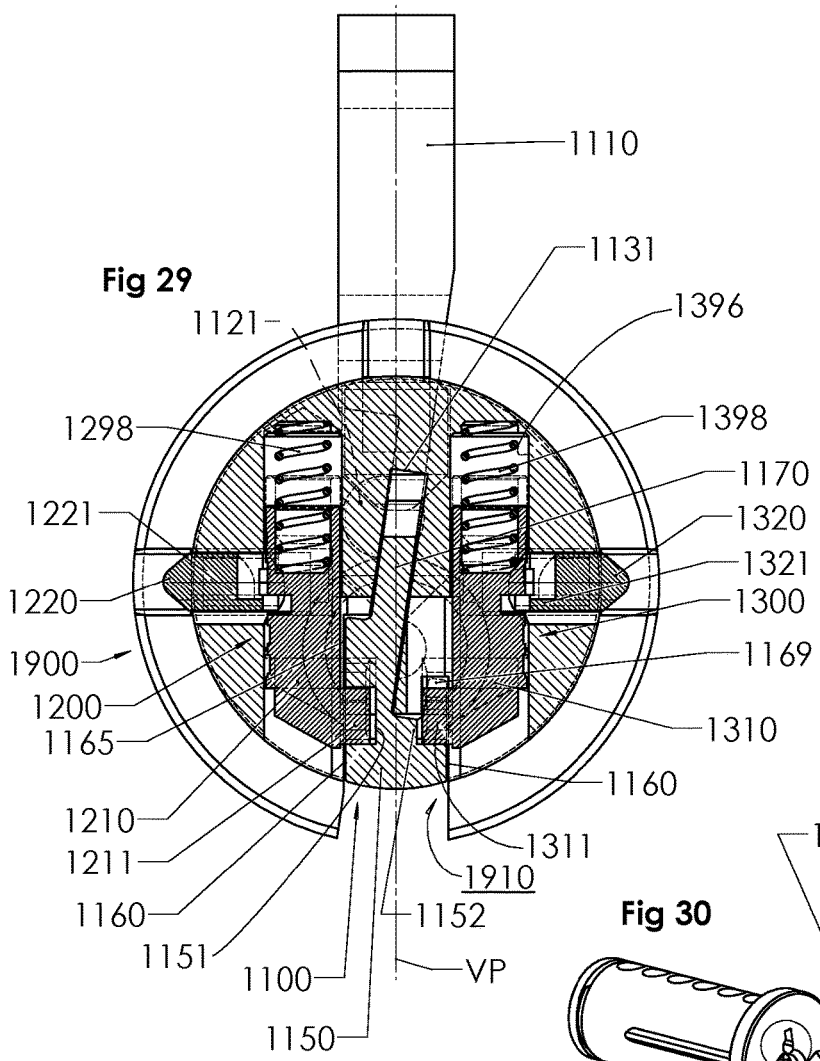
FIG. 29 shows a cross-sectional view of a key plug with an inserted key blade, the grip portion being unitary with the key blade being also visible.

In FIG. 29, there is shown how a key 1100, corresponding essentially to the above-described key shown in FIG. 20 but being viewed in an opposite longitudinal direction, cooperates with two side locking mechanisms in the key plug. The key is also provided with central V-cuts 1131 at the upper edge surface 1171 (FIG. 30), as described above with reference to FIG. 2.

The key 1100 cooperates, in the embodiment of FIG. 29, with two side locking mechanisms 1200 and 1300, respectively, on each side of a central keyway 1910 in the rotatable key plug 1900 of the associated lock (not shown here in its entirety). Such side locking mechanisms are previously known, e.g. from the above-mentioned U.S. Pat. No. 10,337,210 B2 (Widén) and the corresponding continuation-in-part U.S. Pat. No. 10,570,643 B2 (Widén), the latter relating to a cylinder lock core for a cylinder lock unit. In the context of the present invention, however, the side code patterns on the key blade 1150 are not necessarily confined to a longitudinal half of the key blade located closest to the grip portion 1110 of the key, but may extend along the entire length of the key blade, on one side or both sides thereof, or only along a part of the length. Possibly, there is only one side locking tumbler on each respective side.

In the embodiment of FIG. 29, each side locking mechanism comprises one or more side locking tumblers 1210 and 1310, respectively, each having a transverse finger 1211, 1311 projecting sideways into a side code pattern 1151, 1152 located in each respective lateral side surface of the lower and interconnecting parts 1160, 1165 of the key blade 1150. On the second side of the key, to the left in FIG. 29, the side code pattern 1151 is located partly in the interconnecting part 1165 of the key blade.

Like in the embodiments described above, the upper part 1170 of the key 1100 is slightly inclined relative to the vertical mid-plane thereof (in this embodiment coinciding with the vertical central plane VP of the key plug), and the key 1100 also has, at its first side (to the right in FIG. 29), an upright ridge 1169 (most of it being hidden by the transverse finger 1311 in the drawing), in which the side code pattern 1152 is located, e.g. in the form of wave-like recess (not shown) in the material of the key blade. The wave-like side code pattern includes coded concavities at different levels, possibly also including an extra code level at the top of the ridge portion 1169, as is previously known from U.S. Pat. No. 7,159,424 (Widén).

In FIG. 29 it is seen that the wave-like side code pattern 1152, on the first side (to the right) of the key blade, is provided with only one wave-like guiding surface, on which the transverse finger 1311 is supported and guided when the key blade is inserted into the keyway 1910, whereas the wave-like side code pattern 1151, on the second side (to the left) of the key blade has upper and lower, mutually parallel guiding surfaces which forcedly guide the finger 1211 of the side locking tumbler 1210 along the wave-like pattern 1151 which is formed as a groove on the second side (to the left) of the key blade 1150.

The finger 1311 (to the right in FIG. 29) is held down on the associated guiding surface by means of an upper helical spring 1398, so that the side locking tumbler 1310, when the key 1100 is inserted into the keyway 1910, moves up and down in an associated chamber 1396 extending vertically on a lateral side of the central keyway 1910. On the second side (to the left in FIG. 29) the wave-like part of the side code pattern 1151, forming a groove, extends only along a part of the total length of the key blade, and merges with a straight portion and a downwardly slanted end portion (not shown) near the tip of the key blade. When the key 1100 is totally withdrawn from the keyway 1910 in the key plug 1900, a helical spring 1298 will hold the side locking tumbler 1210 in a lowermost position.

When the side locking tumblers 1210, 1310 are located in the positions shown in FIG. 29, defined by the vertical location of the respective concavity of the side code patterns 1151, 1152, a side bar 1220 and 1320, respectively, will have its inwardly (towards the centre of the key plug) projecting lug positioned in registry with an associated recess in an outer surface of the respective side locking tumbler 1210, 1310. In this way, when the key plug is rotated by means of the inserted key 1100, the side bars 1220 and 1320 will be permitted to move inwardly towards the centre of the key plug 1900, and thereby disengage from associated grooves (not shown) in the housing (not shown either) of the cylinder lock. Thus, the lock may now be opened by a further rotational movement of the key 1100.

In principle, the side locking mechanisms 1200 and 1300 are previously known per se in the prior art technology of cylinder locks, but not in combination with a key 1100 according to the present invention having a single, inclined, relatively narrow upper part 1170 of the key blade 1100.

Figure 30:
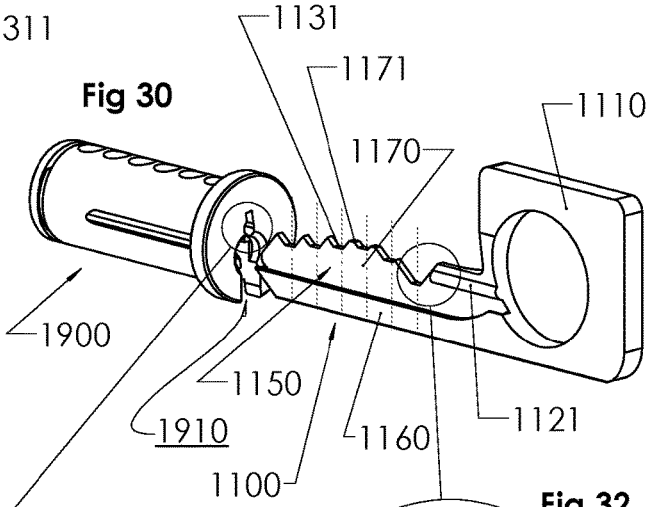
FIG. 30 shows the key and the key plug of FIG. 29 in a perspective view, the key being pulled out from the key plug.
Figure 31:
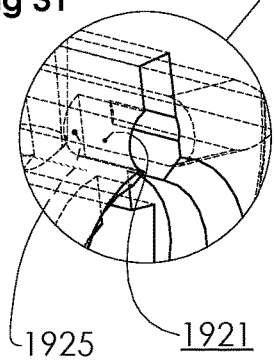
FIGS. 31 and 32 show two enlarged details from FIG. 30.
Figure 32:
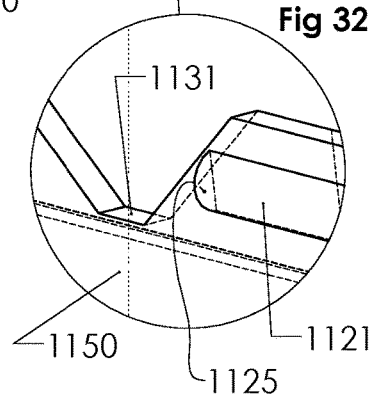
Figure 33:
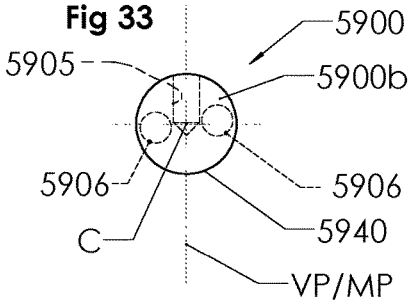
FIGS. 33 to 44 illustrate schematically how a keyway in a key plug may be formed in a blank by means of one or more rotating cutter disc units.

FIGS. 30, 31 and 32 also illustrates another possible feature, involving a stop arrangement defining the full insertion of the key blade 1150 into the keyway 1910 where the cylinder lock may be released. For this purpose, the key blade 1150 of the key 1100 is provided with a longitudinal rib portion 1121 having an axially well-defined end surface 1125 located at a relatively small distance from the grip portion 1110 of the key 1100. In the keyway 1910 of the key plug 1900, there is an associated axial cavity or bore 1921, see FIG. 31. The axial bore 1921 has a shape corresponding to the axial rib portion 1121 of the key blade 1150, so as to accommodate the axial rib portion 1121, when the key 1100 is being inserted into the keyway 1910 of the key plug 1900. The axial length of the bore 1921 is selected so that, when the end surface 1125 of the rib portion 1121 abuts a bottom surface 1925 of the axial bore 1921, the key 1100 is positioned so as to define the full insertion of the key blade into the keyway permitting the lock to be released and opened by turning of the key 1100.

Such a pair of an axial rib portion and an axial bore may be provided also on the other side of the lock and key combination, if so desired.

When the key is being inserted into the keyway of the key plug, it will be stopped provided all the central locking pins and the possible side locking tumblers of the key plug are situated in positions that will enable a rotation of the key plug within the housing of the cylinder lock, so that the lock may be released by turning of the key and the key plug within the housing. Moreover, the associated key plug is provided with the second abutment surface either in a longitudinal cavity formed at a lateral side of the keyway of the key plug (as shown in FIG. 31), or by a front end surface located at a radially widened front end portion of the key plug. The stop arrangement is such that the first and second abutment surfaces on the key and key plug will make contact with each other when the central locking pins and the possible side locking tumblers are located in their unique positions that will permit a rotation of the key plug within the associated housing of the cylinder lock.

Such a stop arrangement is disclosed, in a more general form, in a separate patent application being filed by the same applicant on the same date as the present application. The disclosure of the separate patent application, entitled "A key blank, a coded key and a cylinder lock and key system with improved stop arrangement" identified in the Cross-Reference to Related Applications above is incorporated herein by reference.

Method to Manufacture a Key Plug from a Blank

The scope of the present invention also includes a special method, see the FIGS. 38 to 44, to manufacture a key plug as described above, with a slightly inclined upper part of a keyway, from a blank 5900/6900 having (see FIGS. 34 and 35) a cylindrical body 5900*b*/6900*b* with a cylindrical outer contour 5940/6940 around a rotary axis C, a longitudinal keyway 5910/6910 extending in the cylindrical body along a vertical mid-plane MP passing through or adjacent to the rotary axis C, a row of radially oriented central bores 5905/6905 located in the cylindrical body in a vertical central plane VP passing through the rotary axis C and communicating with the longitudinal keyway 5910/6910, a cross-sectional profile of the keyway consisting of at least two parts, viz. a lower relatively wide part 6960 and an upper relatively narrow part 5970/6970, and possibly an interconnecting part, adjoining to the lower and upper parts so as to extend therebetween along the vertical mid-plane MP, wherein the method comprises machining the longitudinal keyway 5910/6910 into the blank, before or after drilling the radially oriented central bores 5905/6905 with axes located in the vertical central plane VP, and wherein, in one major step, at least the upper part 5970/6970 of the keyway in the blank is machined by means of a first cutter disc unit 50 (FIG. 34) including a rotating first cutter disc 55, which is held in a plane which is slightly inclined at a selected angle α, in the interval 3° to 12°, relative to the vertical mid-plane MP of the key plug 5900/6900, the vertical mid-plane MP of the keyway being possibly displaced sideways in relation to the vertical central plane VP of the central bores, a distance no more than 15% of a maximum lateral width of the lower relatively wide part. The rotating first cutter disc 55 is moved longitudinally along the blank with a cutting depth including the lower part 6960, the possible interconnecting part and the upper part 5970/6970 of the keyway.

It should be noted that the blank 5900*b* also includes a pair of prong holes 5906 (in this particular embodiment), one on each side of the keyway to be formed in the blank, as is known per se in this kind of technology, for accommodating a prong serving to transfer a torque from the key plug to a locking member when the key plug is operative in a cylinder lock.

Figure 34:
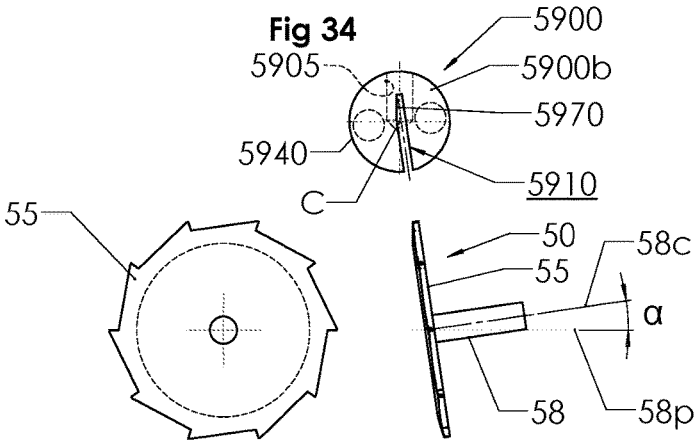
Figure 35:
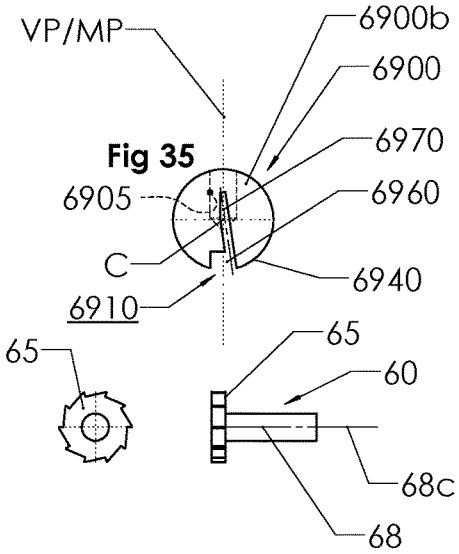

During the major step of the method of manufacturing, see FIG. 34, when the rotating first cutter disc 55 is moved longitudinally along the blank 5905 (perpendicularly to the plane of the drawing figures), a substantially uniform slot 5910 will be formed in the blank, the slot 5910 including the upper part 5970/6970 of the finished keyway and also a (narrow) portion of the lower part 6960 of the finished keyway 6910 (FIG. 35).

The first cutter disc 55 is mounted on a driving shaft 58 which is rotating around its axis 58*c* which is maintained, during the major step, at an angle α (the same angle as the inclinational angle of the upper part of the keyway) relative to a horizontal plane 58*p* which is perpendicular to the plane MP.

A peripheral portion of the rotating first cutter disc 55 may be tapered somewhat (as shown), which will give an uppermost portion of the upper part 5970 of the slot 5910 a slightly tapered shape, in the shown embodiment of the rotating first cutter disc 55 at one lateral side only (the left side in FIGS. 34 and 35). As an alternative, which would be the normal case, the rotating first cutter disc 55 may have a uniform thickness all the way to its outer circumference.

When using a single rotating first cutter disc 55, as shown in FIG. 34, it will be necessary to use another rotating cutter disc unit, such as the second cutter disc unit 60 shown in FIG. 35 in order to complete the keyway. This second cutter disc unit 60 comprises a second cutter disc 65 mounted on a driving shaft 68, the axis 68*c* of which is maintained in a horizontal plane. The thickness of the second cutter disc 65 corresponds to the widened portion of the lower part 6960 of the finished keyway, as appears from FIG. 35. This final shape of the finished keyway 6910 in this embodiment corresponds to the cross-sectional profile of the associated key blank 1100*a* shown in FIG. 12.

Figure 36:
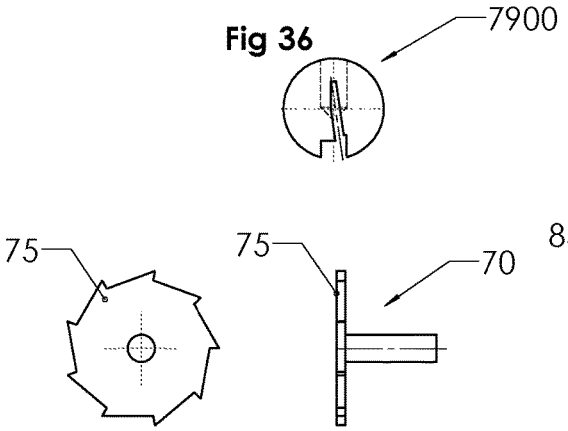
Figure 37:
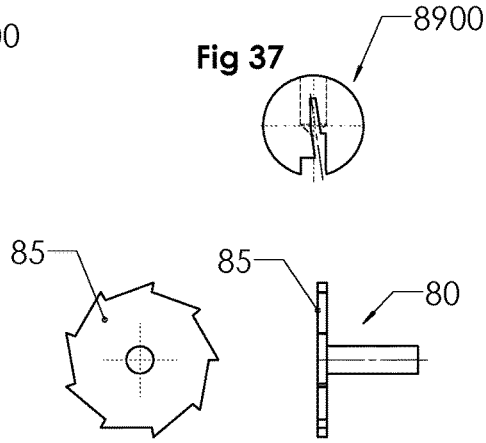
Figure 38:
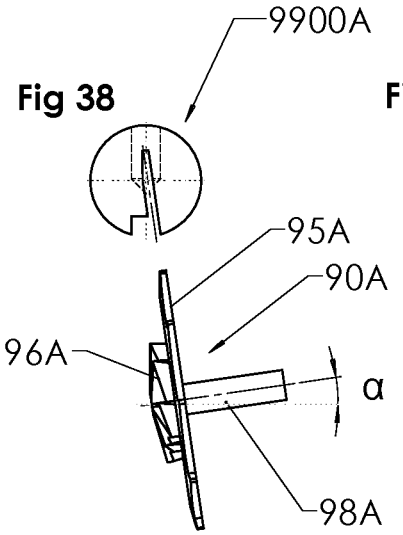
Figure 40:
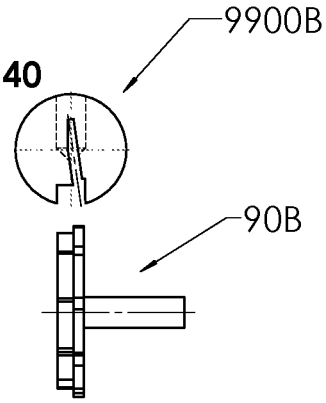
Figure 41:
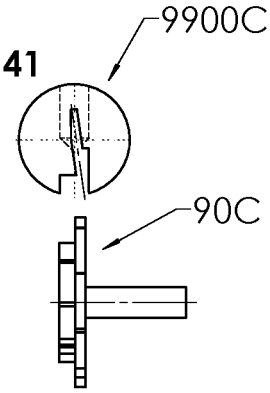
Figure 39:
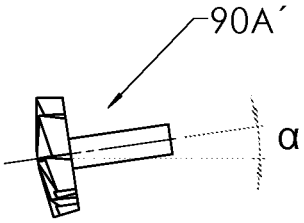
Figure 42:
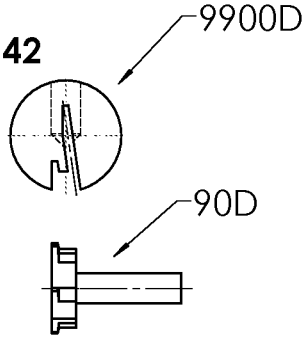
Figure 43:
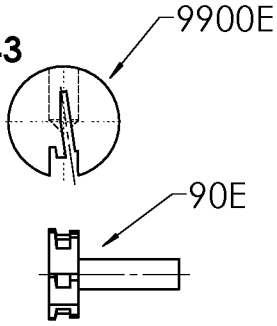
Figure 44:
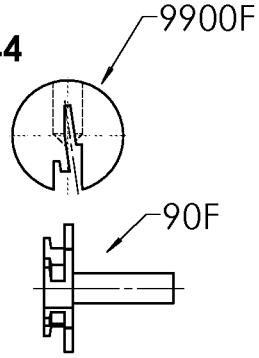

FIGS. 36 and 37 illustrate how other cross-sectional profiles of the keyway may be formed, such as those corresponding to the associated key blanks 1100*b* and 1100*c* (FIGS. 13 and 14), respectively, by using other cutter disc units 70 and 80 including a third rotating cutter disc 75 and a fourth rotating cutter disc 85, respectively. The thickness and the radius of these third and fourth rotating cutter discs 75, 85 may be the same (as shown), or they be different from each other. They are used to form the step-wise transition 1168*b* and 1168*c* on the profiles shown in FIGS. 13 and 14.

As an alternative to machining the keyway in consecutive steps, it is possible to use various kinds of dual rotating disc units, as shown in FIGS. 38 to 44.

The dual rotating disc unit 90A includes two discs 95A, 96A being mounted side by side on the same driving shaft 98A, the disc 95A being the identical to the disc 55 in FIG. 34, and the disc 96A having a shape that will form the widened portion of the lower part of the keyway constituting the finished keyway 6910 in FIG. 35. Thus, with such a dual rotating disc unit, the entire keyway, having the cross-sectional profile shown in FIG. 12, can be formed during one and the same major step of the manufacturing process.

When forming the more complex cross-sectional profiles of the keyway, corresponding to the profiles shown (for the associated key blank) in FIGS. 13, 14, 18, 19 and 20 it is possible to make use of the dual rotating disc units 90B, 90C, 90D, 90E and 90F being configured as shown in FIGS. 40, 41, 42, 43 and 44, respectively.

As compared to traditional prior art methods being used to form various keyways, in particular involving broaching methods, the above-described method utilizing one or more rotating cutter disc units will be faster and more cost-effective.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A key plug for a cylinder lock, comprising:

a cylindrical body with a cylindrical contour around a rotary axis (C), configured to enable a rotary motion of the key plug in a cylindrical bore in a housing of an associated cylinder lock, a longitudinal keyway extending in the cylindrical body along a vertical mid-plane (MP) passing through or adjacent to the rotary axis (C) and being configured to accommodate a substantially flat key blade of an associated key for releasing the cylinder lock, a row of radially oriented central bores being located in a vertical central plane (VP) passing through the rotary axis (C) and communicating with the longitudinal keyway, a row of central locking pins being movable in the central bores and being configured for locking the key plug against rotation relative to said housing unless the key blade of said associated key is inserted into a longitudinal position in said keyway which enables a release of the cylinder lock by turning the key and the key plug in said cylindrical bore of the housing, wherein a cross-sectional profile of said keyway, along a major longitudinal portion of the key plug, is confined within a rectangle having a height being at least 2.5 times greater than a width thereof, said cross-sectional profile including:

a lower relatively wide part, having a maximum width being substantially the same as or slightly less than the width of said rectangle, the maximum width being 75% to 100% of the width of the rectangle, measured between a first lower side wall and a second lower side wall, and an upper relatively narrow part serving to enable an interaction between an inserted key blade and said movable central locking pins in said central bores, and possibly an interconnecting part, adjoining to said lower and upper parts of the keyway so as to extend therebetween along said vertical mid-plane (MP), and wherein:

said upper relatively narrow part of the keyway has a relatively small lateral width being no more than 33% of said maximum width of the lower relatively wide part of the keyway and extends obliquely upwards along a first direction (P1) pointing away from said second lower side wall of the lower part and being inclined at a relatively small angle $\alpha$, in the interval 3° to 12°, relative to said vertical mid-plane (MP), and the sideways or lateral location, within said rectangle, of said upper relatively narrow part of said keyway, including first and second upper side walls thereof, is such that an imaginary downward extension thereof, substantially in a second direction (P2) opposite to said first direction (P1) down to said outer cylindrical contour of the key plug, will fall onto said outer cylindrical contour at a same second side of said vertical mid-plane (MP) and inside said second lower side wall of the keyway.

2. The key plug as defined in claim 1, wherein the lower relatively wide part of the keyway:

includes, at a vertical level adjacent to an interconnecting part, a laterally offset region located substantially at a same lateral side of said vertical mid-plane (MP) as said second lower side wall of the keyway, said interconnecting part of the keyway:

adjoins to said laterally offset region of the lower part and extends vertically upwards therefrom, with a central side wall located in the vicinity of said vertical mid-plane (MP) and being inclined in said first direction (P1), away from said laterally offset region of said lower part, and with an outside side wall located above and adjoining, possibly via a transition, to said second lower side wall of the keyway, and said upper part of the keyway:

forms an upward extension of said interconnecting part, forms, at said first upper side wall, an upward extension of said central side wall of the interconnecting, and also adjoins, at the opposite second upper side wall, to said outside wall of the interconnecting part, possibly via a transition.

3. The key plug as defined in claim 1, wherein said interconnecting part of the keyway:

is configured so as to establish a free visual communication between said lower relatively wide part of the longitudinal keyway and said central bores only via a respective narrow opening passage (NOP) being offset laterally sideways in relation to said vertical mid-plane (MP), predominantly on said second side of said vertical mid-plane (MP), whereas said first upper side wall of said upper part is located predominantly on the opposite first side of said vertical mid-plane (MP), and said narrow opening passage (NOP), as seen in a direction in parallel to said vertical mid-plane (MP), has a lateral width which is less than 25% of said maximum width of said lower relatively wide part.

4. The key plug as defined in claim 1, wherein said relatively small lateral width of said upper part of the keyway is substantially uniform along the vertical extension of said upper part, possibly with a tapering uppermost portion thereof.

5. The key plug as defined in claim 1, wherein at least a part of said first and second upper side walls of said upper part of the keyway are located on a first side and on a second side, respectively, of said vertical mid-plane (MP).

6. The key plug as defined in claim 1, wherein a central side wall of said interconnecting part of the keyway crosses said vertical mid-plane (MP).

7. The key plug as defined in claim 1, wherein a lower end portion of each respective central bore is selected from the group of a taper, a conical and a chisel, and accommodates an associated central locking pin with a correspondingly tapered lower end portion, which has a lowermost central end surface at its apex, said lowermost central end surface, preferably having a rounded shape, being at least partly concealed when being observed or manipulated from underneath, when there is no associated key inserted into the keyway and the associated central locking pin is being held in its lowermost position.

8. The key plug as defined in claim 1, wherein a total vertical height of said interconnecting part and said upper part of the keyway is in the interval 50% to 85% of a total vertical height (h) of the keyway.

9. The key plug as defined in claim 1, wherein the lower part of the keyway has an upper first transverse wall located substantially on the same lateral side of said vertical mid-plane (MP) as said first upper side wall of the upper part of the keyway, said transverse wall forming a corner with an adjoining central side wall of said interconnecting part, said corner being located in the vicinity of said vertical mid-plane (MP), and said first transverse wall forming at least a part of a first step-like transition between said lower part and said interconnecting part.

10. The key plug as defined in claim 9, wherein said first transverse wall extends laterally all the way from said first lower side wall of the lower part to said corner, so as to form said first step-like transition.

11. The key plug as defined in claim 9, wherein said first step-like transition also comprises an upward extension, configured to accommodate a ridge of an associated key blade, said upward extension having an outside wall portion adjoining to said first lower side wall of said lower part of the keyway, a top wall portion, and an inside wall portion adjoining to said first transverse wall, said first transverse wall forming only a part of said first step-like transition, and there being formed a centrally located downwardly directed tongue being defined by said inside wall portion, said first transverse wall with said corner, and said central side wall of said interconnecting part.

12. The key plug as defined in claim 10, wherein said second upper side wall of the upper part of said keyway adjoins as a substantially straight extension through said interconnecting part to said second lower side wall of the lower part, or there is also a second transition on said other side of the vertical mid-plane (MP), where said second upper side wall of the upper part adjoins to said outside surface of the interconnecting part.

13. The key plug as defined in claim 1, the key plug comprising a front end portion extending along less than half of a total length of the key plug, and an adjoining rear end portion along more than half of said total length, wherein said front end portion-accommodates a side locking mechanism with side locking tumblers reaching into the longitudinal keyway, whereas said rear end portion accommodates one or more additional lock components at a lateral side of the longitudinal keyway.

14. The key plug as defined in claim 1, in combination with said housing, so as to form said cylinder lock.

15. The cylinder lock as defined in claim 14, the key plug accommodating one or more side locking tumblers on one or both lateral sides of said keyway, each side locking tumbler being movable in an associated cavity and having a part reaching into the keyway of the key plug, said side locking tumbler cooperating with said housing so as to prevent rotation of the key plug relative to said housing unless a correctly cut key is inserted into a longitudinal position in said keyway which enables a release of the cylinder lock by turning the key and the key plug in said cylindrical bore of the housing.

16. The cylinder lock as defined in claim 14, in combination with said associated key with a substantially flat key blade, so as to form a cylinder lock and key combination, said substantially flat key blade having at least one key code pattern, namely:

a central key code pattern adjacent to an upper edge surface of said upper part of said substantially flat key blade, with a longitudinal row of coded cuts, configured to interact with said movable central locking pins in the key plug of the cylinder lock, and possibly also at least one side code pattern in a respective side surface portion of said substantially flat key blade, configured to interact with side locking tumblers of a side code mechanism of the cylinder lock.

17. A cylinder lock and key combination as defined in claim 16, wherein:

the key and the associated cylinder lock are provided with a stop arrangement adapted to stop the insertion of the key into the cylinder lock at a position where first and second abutment surfaces on the key and the key plug will make contact and all the locking pins and possible side locking tumblers of the key plug are situated in positions that will enable a rotation of the key plug within the housing of the cylinder lock, so that the lock may be released by turning of the key and the key plug within the housing, the key being provided with a longitudinal profile rib having a forward end surface, constituting the first abutment surface, located at a selected fraction of the whole length between a grip portion of the key and a bitted portion of the key blade, and the associated key plug being provided with the second abutment surface:

either in a longitudinal cavity formed at a lateral side of the keyway of the key plug, or formed by a front end surface located at a radially widened front end portion of the key plug.

18. A method to manufacture a key plug from a blank having:

a cylindrical body with a cylindrical outer contour around a rotary axis (C), a longitudinal keyway extending in said cylindrical body along a vertical mid-plane MP passing through or adjacent to said rotary axis (C), a row of radially oriented central bores located in said cylindrical body in a vertical central plane (VP) passing through said rotary axis (C) and communicating with said longitudinal keyway, a cross-sectional profile of said keyway consisting of at least two parts, viz. a lower relatively wide part and an upper relatively narrow part, and possibly an interconnecting part, adjoining to said lower and upper parts so as to extend therebetween along said vertical mid-plane, wherein said method comprises:

machining the longitudinal keyway into the blank, before or after drilling said radially oriented central bores with axes located in said vertical central plane (VP), machining, in one major step, at least the upper part of the keyway in said blank by means of a first cutter disc unit including a rotating first cutter disc, which is held in a plane which is slightly inclined at a selected angle $\alpha$, in the interval 3° to 12°, relative to said vertical mid-plane (MP) of the key plug, and possibly displacing said vertical mid-plane (MP) of said keyway sideways in relation to said vertical central plane (VP) of said central bores, a distance no more than 15% of a maximum lateral width of said lower relatively wide part, and said rotating first cutter disc being moved longitudinally along said blank with a cutting depth including said lower part, said possible interconnecting part and said upper part of the keyway.

19. The method as defined in claim 18, wherein said rotating first cutter disc unit also includes a driving shaft, on which the first cutter disc is mounted, said driving shaft being maintained, during the longitudinal movement of the rotating cutter disc, at said selected angle $\alpha$ relative to an axis which is perpendicular to said vertical mid-plane (MP).

20. The method as defined in claim 18, wherein further machining steps are carried out, before or after said one major step, to further widen the keyway as desired in one or more of the lower part, the possible interconnecting part and the upper part of the keyway.

* * * * *